US009335697B2

(12) United States Patent
Yoshida et al.

(10) Patent No.: US 9,335,697 B2
(45) Date of Patent: May 10, 2016

(54) IMAGE FORMING APPARATUS HAVING IMAGE BEARING MEMBER LIFE ESTIMATION UNIT

(71) Applicant: CANON KABUSHIKI KAISHA, Tokyo (JP)

(72) Inventors: Masahiro Yoshida, Tokyo (JP); Kohei Matsuda, Fujisawa (JP); Kuniaki Tamagaki, Kawasaki (JP); Koichiro Takashima, Fujisawa (JP); Nobuo Oshima, Inagi (JP); Masanori Tanaka, Yokohama (JP); Takashi Mukai, Kawasaki (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 60 days.

(21) Appl. No.: 13/937,031

(22) Filed: Jul. 8, 2013

(65) Prior Publication Data

US 2014/0016953 A1 Jan. 16, 2014

(30) Foreign Application Priority Data

Jul. 10, 2012 (JP) ..... 2012-154479

(51) Int. Cl.
*G03G 15/00* (2006.01)
*G03G 21/00* (2006.01)

(52) U.S. Cl.
CPC ..... *G03G 15/55* (2013.01); *G03G 15/5033* (2013.01); *G03G 15/553* (2013.01); *G03G 21/0094* (2013.01)

(58) Field of Classification Search
CPC ..... G03G 15/553
USPC ..... 399/26
See application file for complete search history.

(56) References Cited

U.S. PATENT DOCUMENTS

| | | | | |
|---|---|---|---|---|
| 5,778,279 | A * | 7/1998 | Kawai et al. | |
| 5,805,951 | A * | 9/1998 | Kato et al. | 399/26 |
| 6,917,777 | B2 * | 7/2005 | Nishiwaki et al. | |
| 7,395,014 | B2 * | 7/2008 | Kim et al. | |
| 7,813,670 | B2 * | 10/2010 | Matsuda | |
| 2005/0053853 | A1 * | 3/2005 | Sugino et al. | |

FOREIGN PATENT DOCUMENTS

| | | | |
|---|---|---|---|
| JP | 07175374 | A * | 7/1995 |
| JP | 2001-356655 | A | 12/2001 |
| JP | 2009169002 | A * | 7/2009 |

* cited by examiner

*Primary Examiner* — Walter L Lindsay, Jr.
*Assistant Examiner* — Milton Gonzalez
(74) *Attorney, Agent, or Firm* — Canon USA Inc. IP Division

(57) ABSTRACT

An image forming apparatus includes a photosensitive drum life estimation mechanism which estimates wear amounts of a charge transfer layer in both of a toner bearing area and an end portion of a toner non-bearing area of a developing roller and informs a user that the photosensitive drum has reached the end of its life if, out of total wear amounts of the areas corresponding to predetermined life threshold values of the toner bearing and non-bearing areas, either of the total wear amounts reaches the threshold value.

11 Claims, 9 Drawing Sheets

IMAGE FORMING APPARATUS HAVING IMAGE BEARING MEMBER LIFE ESTIMATION UNIT

BACKGROUND OF THE INVENTION

1. Field of the Invention

The present invention relates to an electrophotographic apparatus. More particularly, the present invention relates to a tandem-type color electrophotographic apparatus including image forming units using toner of a plurality of colors.

2. Description of the Related Art

Nowadays, organic photosensitive members are widely used as photosensitive drums, which are image bearing members, of electrophotographic apparatuses for cost and productivity reasons. An organic photosensitive member includes a photosensitive layer (organic photosensitive layer), which is made of an organic material (charge generation material or a charge transfer material) and formed on a supporting member. As the organic photosensitive member, a photosensitive drum (hereinafter referred to as a drum) having a stacked type photosensitive layer is in the mainstream. This is because it offers high sensitivity and allows diverse material designs. The stacked type photosensitive layer includes a charge generation layer including the charge generation material and a charge transfer layer including the charge transfer material.

Generally, various layers are provided between the supporting member and the photosensitive layer. The layers are helpful in enhancing coatability of the surface of the supporting member, coating performance of the photosensitive layer, adhesion of the supporting member and the photosensitive layer, protection performance of the photosensitive layer from electrical damage, charging property, and charge injection property of charges from the supporting member to the photosensitive layer.

For example, a conductive layer and a middle layer are provided between the photosensitive layer and the supporting member. The conductive layer coats the surface of the conductive supporting member. The middle layer can act as a barrier for electrically preventing the charge injection from the conductive layer to the photosensitive layer. By providing these layers, a drum with stable quality and manufacturing can be obtained. As a binding resin of the transportation layer of the drum, a polycarbonate resin and a polyallylate resin are widely used. The polyallylate resin enhances the mechanical strength.

Further, a contact charge roller is widely used as a charging device that charges the drum so that the drum has a predetermined polarity and electric potential since it is inexpensive and allows ozoneless configuration. The contact charge roller has a layer of an elastic rubber material on a cored bar. The contact charge roller is pressed against the drum at a predetermined pressure and rotates according to the rotation of the drum. The electric discharge occurs according to an application of a predetermined bias to the cored bar. A predetermined surface potential of the drum is obtained by this electric discharge.

The electrophotographic apparatus also includes a development device. The development device, which is used for developing an electrostatic latent image by developer, includes a developer container that contains toner as the developer, a developing roller that conveys the toner to the drum, and a developer restricting member which applies charge to the toner so that a thin layer is uniformly formed on the surface of the developing roller.

As toner for a full-color electrophotographic apparatus, nonmagnetic one-component toner is generally used. Further, as the developing method, a method called contact developing method is widely used since it allows inexpensive and small configuration. The contact developing method is used for transferring toner on the developing roller to the drum by causing the developing roller, having a thin layer of toner, to contact the drum.

Further, the electrophotographic apparatus includes a cleaning device which removes untransferred developer from the drum. The cleaning device is configured of a cleaning blade formed by an elastic rubber material such as urethane rubber and a waste toner container. The removed toner is collected in the waste container. A method called counter contact cleaning method is widely used as the cleaning method. According to this method, the cleaning blade is pressed against the drum at a predetermined pressure and the toner that remains on the drum surface is physically scraped and collected by the cleaning blade.

As the full-color electrophotographic apparatus, a tandem type apparatus which allows high speed printing is widely used. The tandem type apparatus includes a plurality of drums each of which corresponds to each toner color. Normally, a full-color electrophotographic apparatus uses toner of four colors, which are yellow, magenta, cyan, and black. A color image can be reproduced by superimposing each toner.

Regarding the tandem type apparatus, image forming units for respective colors are provided along the intermediate transfer member. Each of the image forming units includes a drum, a charging device, a development device, and a cleaning device. The image forming unit of each color is hereinafter referred to as an image forming station. As the image forming process, toner developed on the drum at each image forming station is primary transferred onto the intermediate transfer member at each image forming station. Then, the toner image is simultaneously secondary-transferred onto a print medium such as paper.

Generally, a full-color electrophotographic apparatus is capable of monochromatic printing using black toner in a mode called monochrome mode. When the full-color electrophotographic apparatus is in the monochrome mode, it is desirable not to use the drum and the development device of each image forming station other than the black image forming station so as to extend the life of such devices.

However, in order to prevent upsizing of the apparatus and reduce the cost due to complexity of devices (e.g., drive device), some full-color electrophotographic apparatuses have the drums of all colors rotate in the monochrome mode although they do not drive the developing rollers of the image forming stations of the colors other than black. Further, some apparatuses perform exposure of drums corresponding to image forming stations of colors other than black so that the static charge is eliminated from the drums and the untransferred black toner is not collected at the image forming stations of colors other than black when the drums of all colors rotate.

Further, there are cartridge-type image forming apparatuses each of which detachably mounts a process cartridge including the charging device, the drum, the development device, and the cleaning device on the apparatus main body of the image forming apparatus. With this system, the maintenance of the image forming apparatus can be performed by a user without help of a service engineer. For example, if the toner runs out or the drum reaches the end of its life, the user of the image forming apparatus can replace the cartridge to form an image again.

Regarding the cartridge-type image forming apparatus, when consumables such as the drum or the developer reach the end of their life or the end of their life is nearing, it has to be informed to the user so that the cartridge can be replaced by a new one at suitable timing by a user. The drum life is generally determined by the amount of film thickness of the surface layer, which is a charge transfer layer including a charge transfer material, which wears over time. The surface layer is hereinafter referred to as a CT layer.

As described above, during the image forming process, an electrical/mechanical external force is applied to the drum, for example, by the discharge process, sliding friction by the developing roller and the intermediate transfer member, and scraping by the cleaning blade. As a result, the CT layer wears. Under such circumstances, there are proposed various methods for determining the drum life before image unevenness and fogging becomes noticeable by estimating the wear amount of the CT layer.

Among such proposes, Japanese Patent Application Laid-Open No. 2001-356655 discusses a life determining unit which determines the life of a drum by comparing a value obtained by integrating the application time of the charge unit or the application time of the development unit for the drum, with life information of the drum.

FIG. 5 illustrates the arrangement of the drum, the charge roller, the developing roller, and the cleaning blade of a conventional publicly-known contact development system in the longitudinal direction of the drum. In FIG. 5, a photosensitive drum 100 as an image bearing member, a charge roller (charging member) 201 as a charging device, a developing roller 401 as a developer bearing member, a cleaning blade rubber unit (hereinafter referred to as a cleaning blade) 601 as a cleaning member, toner seals 210 as toner seal members are arranged in the contact development system.

A toner seal 210 is provided at each end portion of the developing roller 401, between the frame of the development device and the developing roller 401, in order to prevent the toner in the developer container from being scattered. Each end portion of the developing roller 401 is pressed by the toner seal 210. Accordingly, the toner in the developer container is blocked, and scattering of toner at both end portions of the developing roller 401 is prevented.

An area of the developing roller 401 between the contact positions of the toner seals 210 is a toner bearing area (developer bearing area) 220 of the developing roller 401. The areas of the developing roller 401 on the outer sides of the toner bearing area 220 are toner non-bearing areas (developer non-bearing areas) 230 of the developing roller 401.

The surface of the drum 100 which the toner bearing area 220 of the developing roller 401 contacts is referred to as an image forming area (first area) 120. The surface areas of the drum 100 on the outer sides of the first area 120 are referred to as non-image forming areas (second areas) 130.

In order to make the process cartridge smaller in size, in many cases, the end portions of the developing roller 401 are configured so as to be within the area of the cleaning blade 601 in the longitudinal direction. Further, as a portion "d" in FIG. 5 indicates, the end portions of the developing roller 401 may be arranged within a range of 1 to 2 millimeters from the end portions of the charge roller 201. In this configuration, the end face of the charge roller 201 is close to the end face of the developing roller 401. Further, in many cases, both end faces thereof are arranged within the area of the cleaning blade 601. In other words, the end portions of the charge roller 201 and the end portions of the developing roller 401 are within the scraping area of the cleaning blade 601.

In the configuration illustrated in FIG. 5, the wear amount of the CT layer of the drum 100 is not uniform in the longitudinal direction of the drum 100. Especially, the wear amount of the CT layer in the first area 120 to which the toner bearing area 220 corresponds and in the second area 130 to which the toner non-bearing area 230 corresponds are different in the longitudinal direction of the developing roller 401.

The difference mainly occurs due to the difference in the characteristics of the end portions of the developing roller 401 and the end portions of the charge roller 201. Generally, the peripheral speed of the developing roller 401 is faster than the drum 100. Accordingly, the friction caused by the contact and friction of the developing roller 401 wears out the CT layer by mechanical stress. Since the stress that occurs when the developing roller 401 contacts the drum 100 is changed depending on the presence of the toner, the wear amount of the CT layer is different between the first area 120 and the second area 130. In other words, since the developing roller 401 directly contacts the CT layer in the second area 130 where toner is not present, the wear amount of the CT layer in the second area 130 is greater than the wear amount in the first area 120 where toner is present.

Further, at the end portions of the charge roller 201, the electric discharge from the end face of the charge roller 201 is added to the electric discharge from the periphery of the charge roller 201. Thus, the wear amount of the CT layer of the drum 100 corresponding to the end portions of the charge roller 201 is greater than the wear amount of the CT layer corresponding to the portions other than the end portions of the charge roller 201.

Further, as the portion "d" in FIG. 5 indicates, the end portion of the developing roller 401 may be in a range of approximately 2 mm from the end portion of the charge roller 201 and, further, the end portions of both the developing roller 401 and the charge roller 201 may be in the scraping region of the cleaning blade 601. With such configuration, the wear amount of the CT layer at the end portions of the second area 130 where the toner is not present is furthermore increased compared to the first area 120 where the toner is present.

If the wear at the end portions progresses, all the CT layer of the portions corresponding to the end portions may wear out and the conductive layer of the drum 100 may be exposed. In this case, since the periphery of the developing roller 401 or the charge roller 201 directly contacts the conductive layer of the drum 100, leaking of the bias applied to the developing roller 401 or the charge roller 201 to the conductive layer may occur. This leads to fogging due to defective charge or defective image due to defective development. Thus, it is necessary to inform the user that the drum is to reach the end of its life before the CT layer of the drum end portions wears out and the conductive layer is exposed.

If the CT layer at the drum end portions significantly wears out, the life of the drum 100 may be informed according to the wear of the CT layer at the end portions of the second area 130 instead of the wear of the CT layer in the first area 120 which corresponds to the toner bearing area 220 of the developing roller 401.

Further, some image forming apparatuses in the monochrome mode expose the drum 100 of each of the image forming stations of colors other than black to light to remove the static charge while charging the drum 100 so that black toner that remains after the secondary transfer is not collected by the image forming stations other than the black image forming station.

In this case, since the developing roller 401 of each of the image forming stations of yellow, magenta, and cyan does not contact the drum 100 in the monochrome mode, the wear of the CT layer in the second area 130 is smaller in amount.

Under such circumstances, if the time for replacement of the drum 100 is informed based on the wear amount of the CT layer in the second area 130, since the amount of discharge in the first area 120 of the drum 100 is greater and thus the CT layer wears faster, the CT layer in the first area 120 may wear out before the user is informed of the wear.

SUMMARY OF THE INVENTION

The present invention is directed to an image forming apparatus capable of effectively using an image bearing member until the end of its appropriate life.

According to an aspect of the present invention, an image forming apparatus including a rotatable image bearing member having an organic photosensitive layer on a surface, a charging member configured to charge the surface of the image bearing member, an exposure unit configured to form a latent image by exposing the surface of the charged image bearing member, a development device configured to develop the latent image by bearing developer, and a cleaning member configured to clean the surface of the image bearing member, further includes a storage member configured to store a threshold value associated with a wear amount of the organic photosensitive layer, and an image bearing member life estimation unit configured to estimate the wear amount of the organic photosensitive layer, and send out a message informing that the image bearing member has reached the end of its life if the estimated wear amount reaches the threshold value.

Further features of the present invention will become apparent from the following description of exemplary embodiments (with reference to the attached drawings).

DESCRIPTION OF THE EMBODIMENTS

Various exemplary embodiments, features, and aspects of the invention will be described in detail below with reference to the drawings. The dimensions, materials, shapes, and the relative arrangements of the components described in the exemplary embodiments can be changed according to a configuration of an apparatus and various conditions. Therefore, they are not intended to limit the scope of the present invention to the following exemplary embodiments.

Figure 1A:
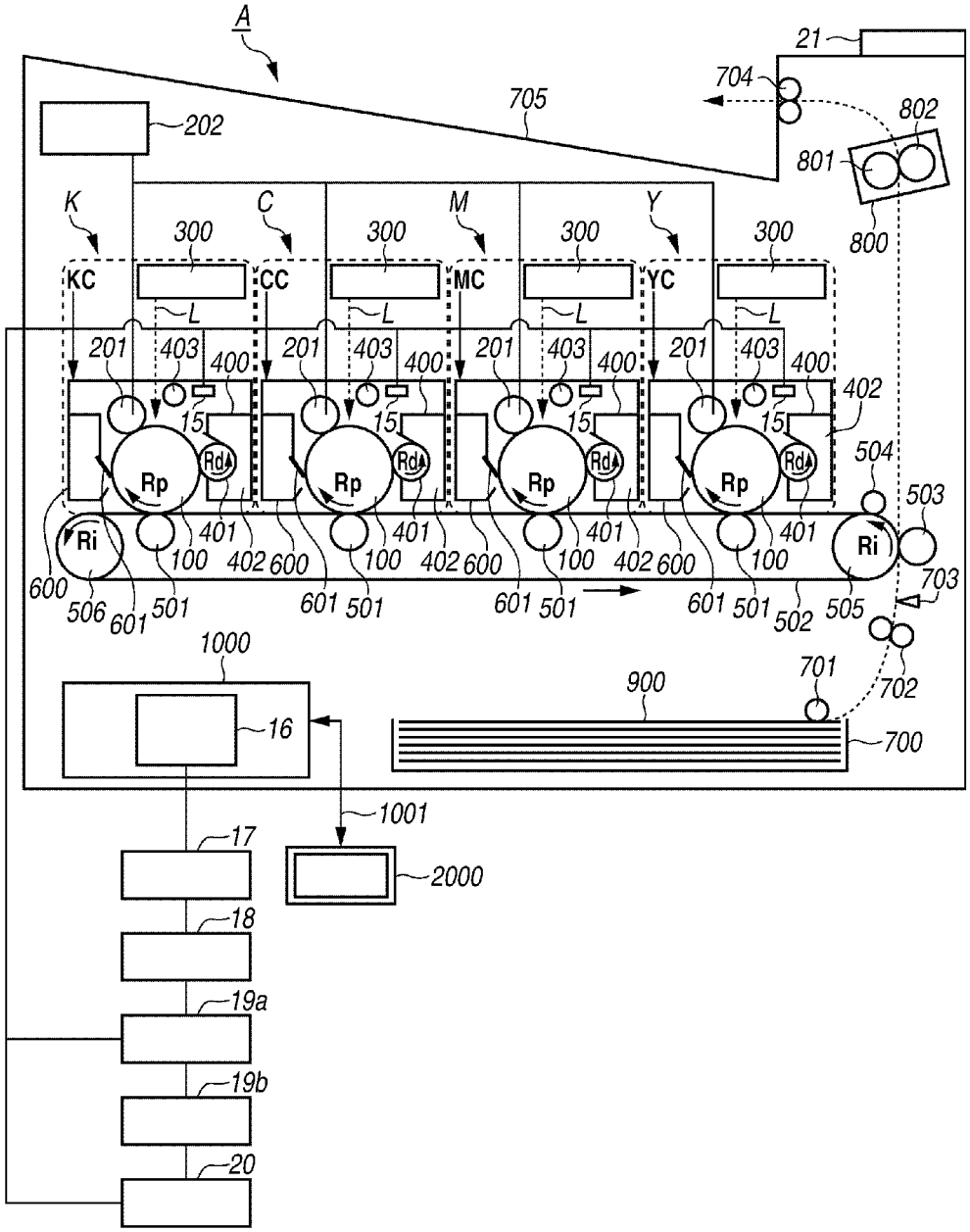
FIG. 1A illustrates a schematic configuration of an image forming apparatus A according to a first exemplary embodiment of the present invention.

A first exemplary embodiment according to the present invention will be described. FIG. 1A illustrates a schematic configuration of an image forming apparatus according to a first exemplary embodiment of the present invention. The members described in the BACKGROUND OF THE INVENTION are denoted by the same numbers in the present exemplary embodiment.

<Image Forming Apparatus>

The image forming apparatus A is an in-line full-color electrophotographic image forming apparatus employing an intermediate transfer method. The image forming apparatus A forms an image corresponding to image data (electrical image information) input from an external host apparatus 2000, which is connected to a printer control unit (i.e., CPU) 1000 via an interface 1001, on a recording material 900 and outputs the image-formed recording material.

The image forming apparatus A has a plurality of image forming execution modes including a full-color mode and a monochrome mode. When the image forming apparatus is in the full-color mode, a full-color image is formed on the recording material 900. When the image forming apparatus is in the monochrome mode, a monochromatic image is formed on the recording material 900.

The printer control unit (hereinafter referred to as a control unit) 1000 performs overall control of the operation of the image forming apparatus A including transmission/reception of various electrical information signals with the external host apparatus 2000 or an operation panel 21. Further, the control unit 1000 is responsible for processing of electrical information signals input from various process devices or sensors, processing of command signals to be transmitted to the process devices, and performing control of predetermined initial sequences and predetermined image-forming sequences. The external host apparatus 2000 is an apparatus such as a personal computer, a network, an image reader, or a facsimile machine.

The image forming apparatus A includes an endless intermediate transfer belt (intermediate transfer member: hereinafter referred to as a belt) 502. The belt 502 is rotatably supported by a drive roller 505 and a counter roller 506 facing the drive roller 505. The belt 502 rotates at a speed of 100 mm/sec in the direction Ri (counter clockwise), indicated by an arrow in FIG. 1B, by the drive of the drive roller 505. The drive roller 505 is driven by a belt drive unit (not illustrated). The volume resistance of the belt 502 according to the present exemplary embodiment is approximately $3\times10^{10}$ ohms-cm under 23 degrees C./50% environment.

A cleaning roller 504 faces a portion of the belt 502 that contacts the drive roller 505. The cleaning roller 504 performs preprocessing for collecting the toner that remains on the belt 502 after the secondary transfer. A cleaning bias is applied to the cleaning roller 504 from a cleaning bias power supply (not illustrated).

A secondary transfer roller 503 faces another portion of the belt 502 that contacts the drive roller 505. The surface layer portion of the secondary transfer roller 503 is formed of an elastic material. When the secondary transfer roller 503 is pressed against the belt 502, a nip portion (secondary transfer nip portion) is formed between the secondary transfer roller 503 and the belt 502. The secondary transfer roller 503 rotates with the rotation of the belt 502 and the conveyance of the recording material 900 conveyed to the nip portion.

A secondary transfer bias is applied to the secondary transfer roller 503 from a secondary transfer bias power supply unit (not illustrated). Attachment/detachment of the secondary transfer roller 503 with respect to the belt 502 is performed at predetermined timing according to drive of a drive unit (not illustrated) so that it does not affect the image forming.

Further, a timing roller pair 702 and a timing sensor 703 are arranged under the secondary transfer roller 503. Furthermore, a cassette 700, which contains the recording material 900, is detachably set under the timing roller pair 702 and the timing sensor 703. The recording material 900 in the cassette 700 is supplied to the timing roller pair 702 one sheet at a time by a recording material supply roller 701. The timing sensor 703 can detect the recording material 900. The detection signal can be used for controlling the apparatus and counting the number of printed sheets. The type of paper used as the recording material 900 is, for example, plain paper, glossy paper, and an overhead projector sheet.

A fixing unit 800 is arranged above the secondary transfer roller 503. The fixing unit 800 includes a fixing roller 801 and a pressure roller 802. The fixing roller 801 is heated by a built-in halogen lamp heater (not illustrated). The pressure roller 802 presses the fixing roller 801. A discharge roller pair 704 and a discharge tray 705 are provided downstream of the fixing unit 800 in the conveying direction of the recording material 900.

Four image forming stations are provided on the upper side of the belt 502 stretched around the drive roller 505 and the counter roller 506. According to the present exemplary embodiment, an yellow image forming station Y, a magenta image forming station M, a cyan image forming station C, and a black image forming station K are arranged along the belt 502 in this order in the belt rotation direction Ri.

The image forming stations Y, M, C, and K are electrophotographic image forming units having a same configuration and are similar except that the color of the developer in the development device is different. Each image forming station includes the drum 100 as an image bearing member. The drum 100 is a rotatable image bearing member having an organic photosensitive layer provided on a conductive supporting member. Various process units that act on the drum 100 are provided along the periphery of the drum 100 in the rotation direction of the drum.

The process units include a charge unit, an image exposure unit 300, a development device 400, and a cleaning unit 600. The charge unit contacts the drum 100 and includes the charge roller 201 as a member that charges the drum surface (surface of the organic photosensitive layer) by an applied voltage. The charged drum surface is exposed by the image exposure unit 300 which is an electrostatic latent image forming unit that forms a latent image.

The development device 400 as a development unit includes the developing roller 401 as a developer bearing member. The developing roller 401 bears and carries developer (toner) to the drum surface to develop the latent image. The cleaning unit 600 which contacts the drum surface includes the cleaning blade 601 as a cleaning member that cleans the developer on the surface of the drum.

According to the present exemplary embodiment, the drums of the image forming stations Y, M, C, and K are arranged at regular intervals of 67 mm. The distance between the drums is hereinafter referred to as a station-to-station distance.

The drum 100, the charge roller 201, the development device 400, and the cleaning unit 600 in each of the image forming stations are integrated into a process cartridge. The process cartridge (hereinafter, cartridge) can be dismounted from an apparatus main body A1 of the image forming apparatus A.

There are four types of cartridges: an yellow cartridge YC for the image forming station Y, a magenta cartridge MC for the image forming station M, a cyan cartridge CC for the image forming station C, and a black cartridge KC for the image forming station K.

A primary transfer roller 501 of each of the image forming stations Y, M, C, and K is provided at the inner side of the belt 502. The primary transfer roller 501 faces the bottom of the drum 100 via the belt 502. The primary transfer roller 501 contacts the bottom of the drum 100 via the belt 502 and rotates according to the rotation of the belt 502. A nip portion where the belt 502 contacts the drum 100 at each of the image forming stations Y, M, C, and K is the primary transfer portion.

A primary transfer bias is applied to the primary transfer roller 501 from a primary transfer bias power supply unit (not illustrated). According to the primary transfer bias, the toner image formed on the drum 100 is primary transferred to the belt 502. The bias applied to the primary transfer roller 501 by the primary transfer bias power supply unit can be changed to a non-collecting bias in the monochrome mode described below. When the bias is changed to the non-collecting bias, the secondary transfer residual toner on the belt 502 is not collected at the drum 100.

The drum 100 of each of the image forming stations Y, M, C, and K is a rotatable image bearing member having an organic photosensitive layer provided on a conductive supporting member. According to the present exemplary embodiment, the drum 100 has a minus electrostatic property and its diameter is 24 mm. The drum 100 rotates in the direction of an arrow Rp (clockwise direction) by drive of a drum drive motor (not illustrated) at the same speed as the rotation speed of the belt 502.

According to the present exemplary embodiment, the conductive supporting member as the base member of the drum 100 is, for example, an aluminum cylinder. Further, a conductive layer of approximately 30 μm, a middle layer and a charge generation layer of approximately 1 μm, and a charge transfer layer of 15 μm (hereinafter referred to as an initial film thickness 15 μm) are laminated on the base member.

The charge roller 201 provided in each of the image forming stations Y, M, C, and K is a charging member having a conductive elastic layer to charge the drum 100 by contacting thereof. The charge roller 201 contacts the drum 100 and rotates according to the rotation of the drum 100. Further, a charge bias for charging the drum surface is applied to the charge roller 201 from a charge bias power supply unit 202 at predetermined timing. Further, the charge bias power supply unit 202 supplies power in common to the four image forming stations Y, M, C, and K.

The image exposure unit 300 of each image forming station is an electrostatic latent image forming unit which exposes the image forming area of the charged surface of the drum 100 to light and forms a latent image. According to the present exemplary embodiment, the image exposure unit 300 is a laser scanning exposure unit. The image exposure unit 300 outputs a laser beam L which is modulated according to the image information input from the external host apparatus 2000 to the control unit 1000. The charged drum surface is scanned and exposed to the laser beam L. Accordingly, an electrostatic latent image is formed.

The development device 400 of each of the image forming stations Y, M, C, and K includes a developing roller (developer bearing member) 401 and a hopper unit (developer container) 402. The developing roller 401 contacts the drum 100 and develops the electrostatic latent image. The hopper unit 402 contains toner as the developer. The developing roller 401 bears and carries the toner supplied from the hopper unit 402, contacts the drum 100, and develops the latent image. The toner has a minus electrostatic property. A developing bias is applied to the developing roller 401 from a developing bias power supply unit (not illustrated), and reversal development is performed.

The developing roller 401 includes a base layer of silicone rubber over a cored bar. Further, a thin layer of a resin material, which is urethane resin including acrylic resin particles dispersed therein, is formed on the base layer. The hardness of the developing roller 401 is degrees when measured by Asker durometer Type C (manufactured by Kobunshi Keiki Co., Ltd.). If micro durometer MD-1 is used, it is 40 degrees.

Figure 1B:
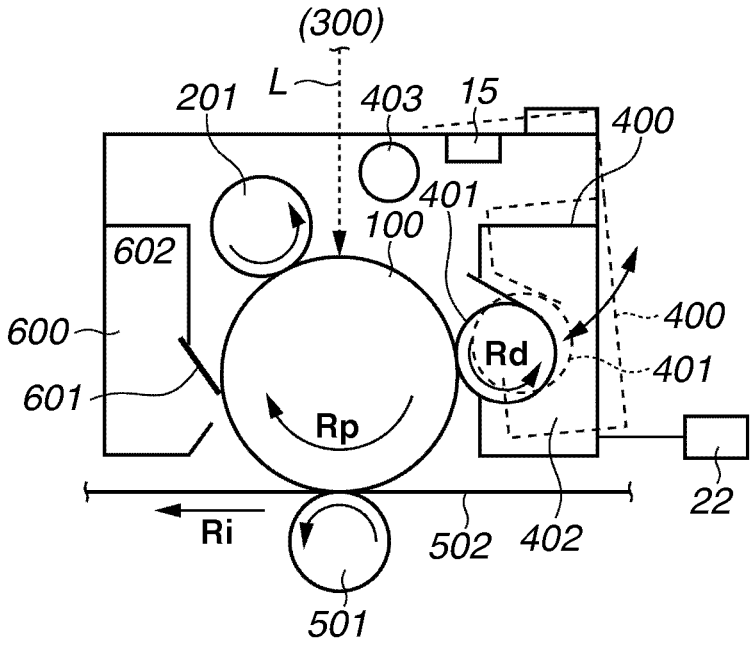
FIG. 1B illustrates a development device contact/separation mechanism of a development device.

A swing center 403 is provided for the development device 400. The developing roller 401 moves about the swing center 403 and can contact the drum 100. The developing roller 401 is also separated from the drum 100 when it moves about the swing center 403. The developing roller 401 contacts the drum 100 and is also separated from the drum 100 according to a mechanism called a development device contact/separation mechanism (development device shift mechanism) 22 illustrated in FIG. 1B provided at each image forming station.

The development device 400 rotates in the direction toward the drum 100 around the swing center 403 by the development device contact/separation mechanism 22 controlled by the control unit 1000. The developing roller 401 is pressed against the drum 100 by a predetermined pressing force as illustrated by a solid line in FIG. 1B. The development roller 401 is maintained at the contact (development) position. In this state, the developing roller 401 rotates with the drum 100 and a developing bias is applied to the developing roller. According to the present exemplary embodiment, when the developing roller 401 contacts the drum 100, the drum 100 is depressed by the developing roller 401. The amount of depression is 50 μm. The rotation speed of the developing roller 401 is 160 mm/sec in the rotation direction of the drum 100 (direction of the arrow Rd in FIG. 1B).

Further, the development device 400 rotates in a direction away from the drum 100 about the swing center 403 for a predetermined amount. Accordingly, the position of the developing roller 401 of the development device 400 is separated and kept at a predetermined distance away from the drum 100. The developing roller 401 illustrated by a chain double-dashed line in FIG. 1B indicates the developing roller 401 in the developing roller separated state (non-developing position). In this state, the rotation of the developing roller 401 is stopped rotating and the developing bias is not applied to the developing roller 401.

The cleaning unit 600 of each of the image forming stations Y, M, C, and K is arranged to contact the drum surface and includes the cleaning blade 601 which is a cleaning member that cleans the toner on the drum surface. The cleaning blade 601 is formed of an elastic member. The cleaning blade 601 contacts the drum 100 and removes the residual toner of the primary transfer from the drum 100 and cleans the drum surface.

According to the present exemplary embodiment, the top edge of the cleaning blade 601 contacts the drum 100 at an angle of 30 degrees with respect to a tangential line at the contact portion. The amount of depression of the drum 100 is approximately 1 mm. The contact pressure of the cleaning blade 601 to the drum 100 is 70 gf/cm.

Figure 5:
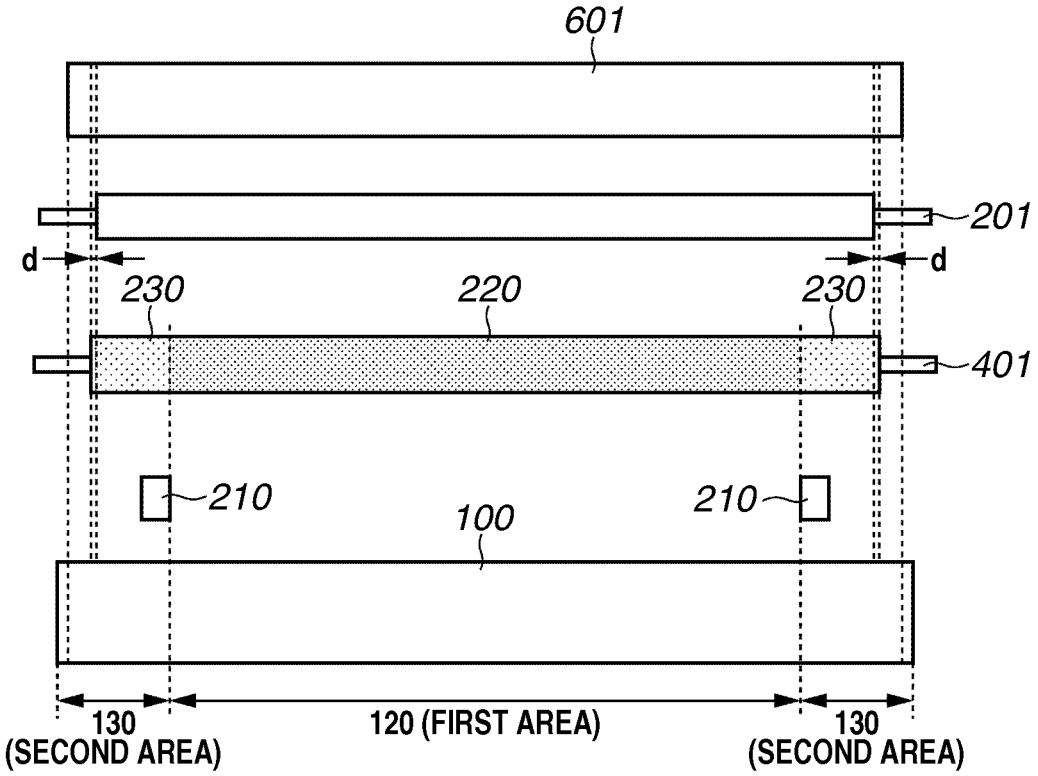
FIG. 5 is a schematic configuration of the photosensitive drum and process units which act on the photosensitive drum in the longitudinal direction of the photosensitive drum.

Further, as illustrated in FIG. 5, the end portions of the roller portion of the developing roller 401 are 1 mm outside the end portions of the roller portion of the charge roller 201. The end portions of the cleaning blade 601 are 3 mm outside the end portions of the developing roller 401. Thus, the end portions of the charge roller 201 and the developing roller 401 are within the scraping region of the cleaning blade 601.

The operation panel 21 receives information from the control unit 1000 and displays information of the state of the image forming apparatus A such as the drum life described below. Further, the operation panel 21 accepts input of various types of information of the control unit 1000.

<Operation of Image Forming Apparatus in Full-Color Mode>

Figure 2:
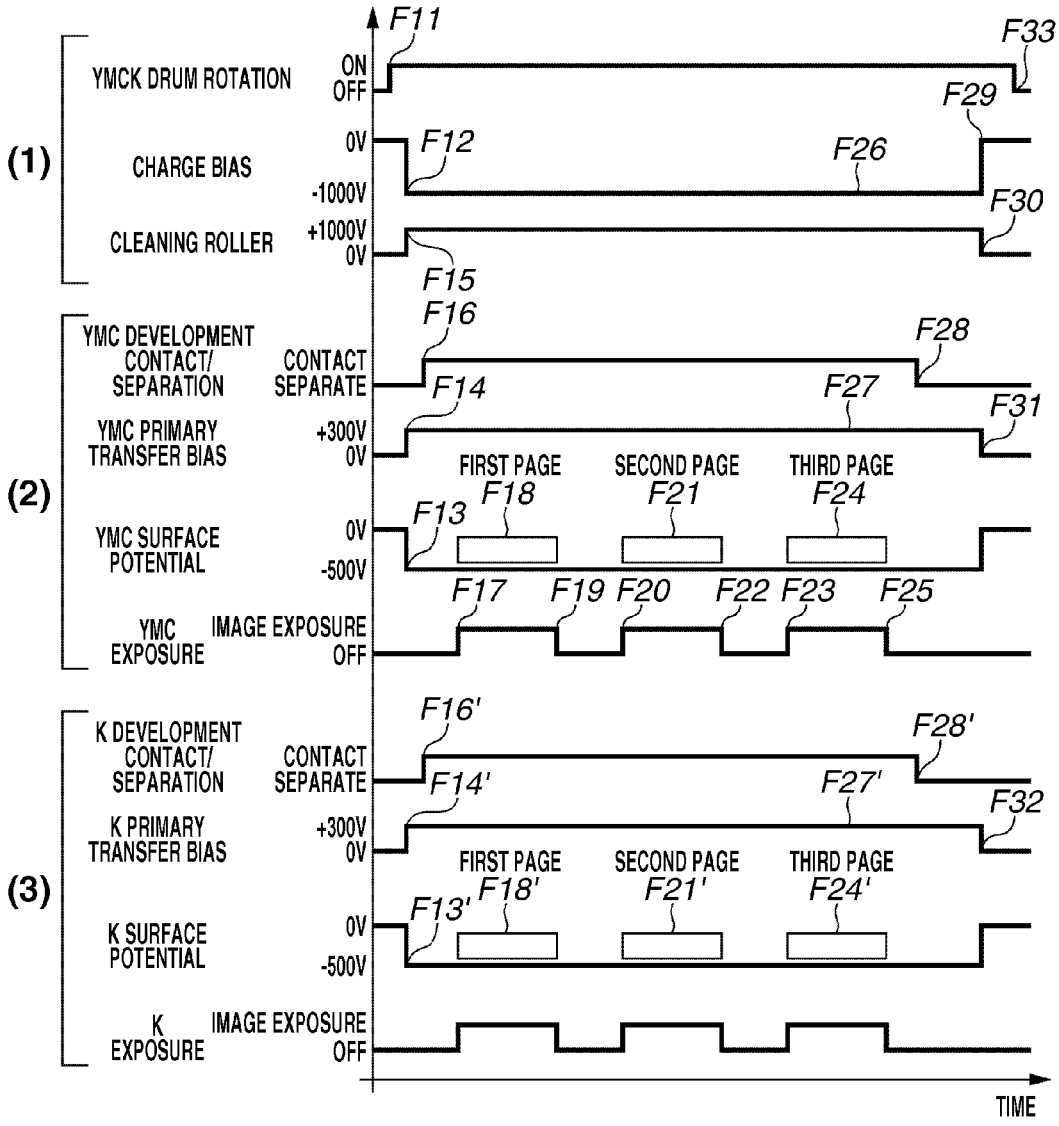
FIG. 2 is a schematic diagram illustrating an operation of the image forming apparatus A in a full-color mode.

The operation of the image forming apparatus A in the full-color mode will be described with reference to FIG. 2. In the description below, three pages of full-color images are continuously formed by using all the image forming stations Y, M, C, and K. FIG. 2 illustrates the operation timing of each member with respect to time. The horizontal axis represents time.

FIG. 2 (1) is a timing chart illustrating ON/OFF of the rotation of the drum 100, ON/OFF of the application of the charge bias, and ON/OFF of the application of the bias to the cleaning roller 504. Further, FIG. 2 (2) is a timing chart illustrating the contact/separation operation of the developing roller 401, ON/OFF of the primary transfer bias, the surface potential of the drum 100, and the exposure operation of the image exposure unit 300 of each of the image forming stations Y, M, and C. FIG. 2 (3) is a timing chart illustrating the contact/separation operation of the developing roller 401, ON/OFF of the primary transfer bias, the surface potential of the drum 100, and the exposure operation of the image exposure unit 300 of the image forming station K.

If the image forming apparatus A is in the standby state, the development device 400 of each of the image forming stations Y, M, C, and K rotates in the direction away from the drum 100 about the swing center 403 by a predetermined amount by the development device contact/separation mechanism 22. In other words, the position of the developing roller 401 of the development device 400 is separated and kept at a predetermined distance away from the drum 100 as illustrated by the chain double-dashed line in FIG. 1B (non-developing position). In this state, the rotation of the developing roller 401 is stopped rotating and the developing bias is not applied to the developing roller 401.

When the image forming apparatus A is in the standby state, if the control unit 1000 receives a print request from the external host apparatus 2000 or the operation panel 21, the control unit 1000 controls the drum 100 of each of the image forming stations Y, M, C, and K to rotate (F11). Simultaneously, a charge bias of −1000 V is applied to the charge roller 201 from the charge bias power supply unit 202 (F12). With this application of the charge bias, the dark portion potential of the surface of the drum 100 will be VD=−500 V (F13, F13').

At the time the charge bias is applied to the charge roller 201, a primary transfer bias of +300 V is also applied to the primary transfer roller 501 (F14, F14'). Further, at the time of this application of the primary transfer bias, a cleaning bias of +1000 V is applied to the cleaning roller 504 (F15).

Next, the control unit 1000 controls the development device contact/separation mechanism 22 so that the development device 400 of each of the image forming stations Y, M, C, and K rotates in the direction toward the drum 100 about the swing center 403. Then, the developing roller 401 of each of the image forming stations Y, M, C, and K is pressed against the drum 100 at a predetermined pressing force as illustrated in FIG. 1B by a solid line and the contact state (development position) of the developing roller 401 and the drum 100 is maintained (F16, F16'). Further, the control unit 1000 controls the developing roller 401 to rotate and also applies a developing bias to the developing roller 401.

The control unit 1000 controls the image exposure unit 300 of the image forming station Y so that exposure corresponding to the image information is performed (F17 to F19). According to this exposure, an electrostatic latent image is formed on the surface of the drum 100 of the image forming station Y (F18). After the electrostatic latent image is formed, the light portion potential VL of the surface of the drum 100 will be −150 V. The electrostatic latent image formed on the drum 100 is developed as a yellow toner image according to an application of a developing bias of −300 V to the developing roller 401. Then, the yellow toner image is primary transferred onto the belt 502 by an application of a primary transfer bias of +300 V to the primary transfer roller 501.

Regarding the surface potential of the drum 100 after the primary transfer of the yellow toner image onto the belt 502, the dark portion potential VD is approximately −250 V and the light portion potential VL is approximately −100 V according to the effect of the primary transfer bias and the dark decay of the potential of the drum 100.

Similarly, at predetermined control timing, a magenta toner image, a cyan toner image, and a black toner image are formed by the drums 100 of the magenta image forming station M, the cyan image forming station C, and the black image forming station K, respectively. Then, the toner images are sequentially transferred onto the belt 502. In this manner, an unfixed full-color toner image of four colors is formed on the belt 502.

At each of the image forming stations Y, M, C, and K, the primary transfer residual toner that remains on the drum 100 after the primary transfer is removed and cleaned by the cleaning blade 601. The removed toner is stored in the cleaning unit 600.

At the yellow image forming station Y, when the image forming operation of the first page is finished, exposure according to the second image information is performed by the image exposure unit 300 (F20 to F22), and an electrostatic latent image is formed (F21). The electrostatic latent image is developed by the development device 400 and an yellow toner image is formed. Further, the yellow toner image is primary transferred onto the belt 502 by the primary transfer roller 501.

A cleaning bias of +1000 V is applied to the cleaning roller 504 (F15) and the secondary transfer residual toner on the belt 502 is charged to positive polarity. Thus, when the yellow toner image of the second page is primarily transferred, the secondary transfer residual toner on the belt 502 is simultaneously collected at the drum 100 and stored in the cleaning unit 600.

By repeating such operations, a full-color image of the third page is also formed. In other words, exposure is performed according to the image information of the third page (F23 to F25) and an electrostatic latent image is formed (F24).

The control unit 1000 separates the developing roller 401 from the drum 100 of each of the image forming stations Y, M, C, and K when the trailing edge of the third page reaches the developing roller 401 (F28, F28'). At the image forming stations Y, M, C, and K after the primary transfer of the full-color toner image of the third page is finished, the charge bias and the primary transfer bias which are applied when the image is formed are continuously applied to the charge roller 201 (F26) and the primary transfer roller 501 (F27, F27').

Then, the secondary transfer residual toner of the full-color toner image of the third page is collected. After the portion corresponding to the trailing edge of the third page is primary transferred by each of the image forming stations Y, M, C, and K and the belt 502 rotates once and returns to the original position of the image forming station, the application of the bias is stopped (F29, F30, F31, F32). After the rotation of the drum 100 is stopped (F33), the image forming apparatus A prepares for the next print request. In other words, the image forming apparatus A stays in the standby state until it receives the next print request.

<Operation of Image Forming Apparatus in Monochrome Mode>

Figure 3:
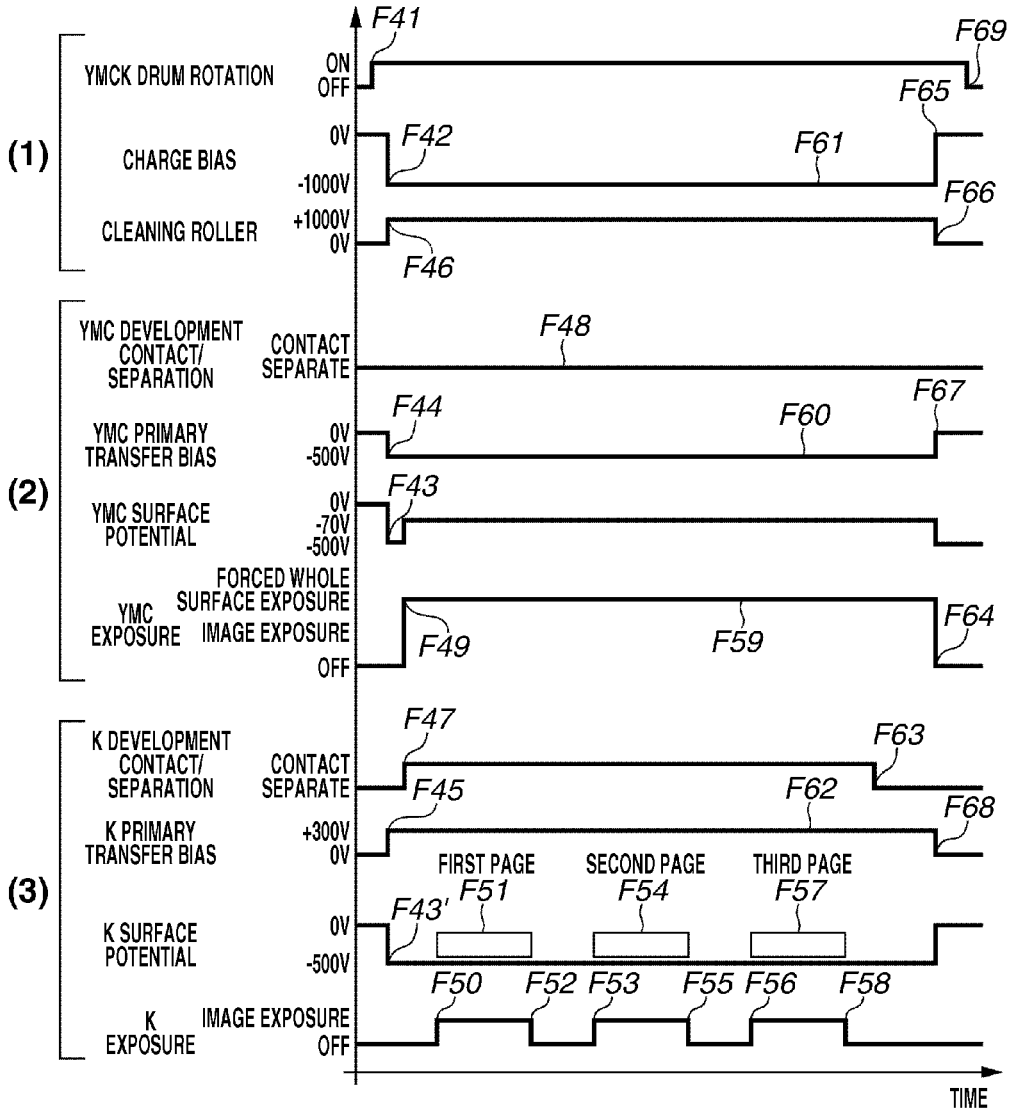
FIG. 3 is a schematic diagram illustrating an operation of the image forming apparatus A in a monochrome mode.

Next, the operation which is performed in the monochrome mode will be described with reference to FIG. 3. Three pages of black output images are continuously formed by the black image forming station K out of the image forming stations Y, M, C and K.

When the control unit 1000 receives a print request, the control unit 1000 controls the drum 100 of each of the image forming stations Y, M, C, and K to rotate (F41). Simultaneously, a charge bias of −1000 V is applied to the charge roller 201 from the charge bias power supply unit 202 (F42). According to this application of the charge bias, the dark portion potential of the surface of the drum 100 will be VD=−500 V (F43, F43').

At the time when the charge bias is applied to the charge rollers 201, a non-collecting bias of −500 V is applied to the primary transfer roller 501 of each of the image forming stations Y, M, and C (F44) and a primary transfer bias of +300 V is applied to the primary transfer roller 501 of the image forming station K (F45). Further, at the same time of the application of the primary transfer bias, a cleaning bias of +1000 V is applied to the cleaning roller 504 (F46).

Next, only the developing roller 401 of the black image forming station K is controlled to contact the drum 100 (F47). The developing roller 401 of each of the image forming stations Y, M, and C does not contact the drum 100 (F48) at that time.

When the developing roller 401 of the black image forming station K contacts the drum 100, forced full-surface exposure is performed by the image exposure unit 300 of each of the image forming stations Y, M, and C which does not contribute to the image forming. The amount of exposure is equal to or greater than the amount used for the exposure of a solid black image (F49). Then, the charge at the surface of the drum 100 of each of the image forming stations Y, M, and C is reduced to around −70 V by the forced full-surface exposure.

According to the forced full-surface exposure and the non-collecting bias, the secondary transfer residual toner which has been charged to positive polarity by the cleaning roller 504 is hardly collected by the image forming stations Y, M, and C.

The forced full-surface exposure of an amount equal to or greater than the amount of exposure for the solid black image is performed so that the secondary transfer residual toner which is charged to positive polarity is not collected by the image forming stations Y, M, and C. In this manner, the secondary transfer residual toner is collected at the image forming station K.

Then, the control unit 1000 controls the image exposure unit 300 of the black image forming station K so that exposure corresponding to the image information is performed (F50 to F52). By this exposure, an electrostatic latent image is formed on the surface of the drum 100 (F51). The electrostatic latent image formed on the drum 100 is developed by the developing roller 401 and a black toner image is formed. A primary transfer bias of +300 V is applied to the primary transfer roller 501 (F45) and the black toner image formed on the drum 100 of the image forming station K is primary transferred onto the belt 502.

In this manner, the black toner image formed on the belt 502 is conveyed to the secondary transfer roller 503 by the rotation of the belt 502. The supply of the recording material 900 to the nip portion, which is formed by the secondary transfer roller 503 and the belt 502, is started according to the timing the black toner image is conveyed by the belt 502. Then, the black toner image is secondary transferred onto the recording material 900 by the secondary transfer roller 503.

At the black image forming station K, the primary transfer residual toner that remains on the drum 100 after the primary transfer of the toner image is removed and cleaned by the cleaning unit 600.

Next, the processing proceeds to the black image forming operation of the second page at the black image forming station K. At the black image forming station K, exposure according to the image information of the second page is performed by the image exposure unit 300 (F53 to F55). By this exposure, an electrostatic latent image is formed on the surface of the drum 100 (F54). Further, a black toner image is formed by the developing roller 401. Further, according to an application of a primary transfer bias of +300 V to the primary transfer roller 501, the black toner image is primary transferred onto the belt 502.

When the black toner image on the drum 100 is transferred onto the belt 502, the secondary transfer residual toner of the black toner image of the first page, which is charged to positive polarity, is collected at the drum 100 of the image forming station K.

By repeating such an operation, the third page of the black image is formed. The exposure is performed according to the image information of the third page (F56 to F58) and an electrostatic latent image is formed (F57) according to the exposure.

At the image forming stations Y, M, and C after the black toner image of the third (last) page is primary transferred, the forced full-surface exposure is continuously performed and the non-collecting bias and the charge bias for the image forming are continuously applied (F59, F60, F61). Further, at the black image forming station K, the charge bias and the primary transfer bias which are applied when the image is formed are continuously applied (F61 and F62). Then, the developing roller 401 of the image forming station K is separated from the drum 100 (F63).

When the secondary transfer residual toner at the trailing edge of the third page of the black image is collected at the black image forming station K, the forced full-surface exposure is stopped and all the bias is turned off (F64, F65, F66, F67, F68). Further, the rotation of the drum 100 is stopped (F69), and the image forming apparatus A prepares for the next print request.

<Photosensitive Drum Life Estimation Unit>

Next, a photosensitive drum life estimation unit (image bearing member life estimation unit), which is characteristic of the present invention, will be described in detail. The image forming apparatus A includes a storage member (storage unit) 15 which stores a plurality of threshold values associated with wear amounts at a plurality of different portions of the CT layer (organic photosensitive layer) of the drum 100. Further, the image forming apparatus A includes a photosensitive drum life estimation unit 16 which estimates the wear amount of the CT layer at each of the plurality of different portions and compares the estimated wear amounts at the plurality of portions and a plurality of threshold values stored in the memory 15. If the wear amount of any of the plurality of portions reaches the threshold value, the user is informed that the drum is nearing the end of its life.

According to the present exemplary embodiment, the plurality of different portions of the CT layer includes the toner bearing area (developer bearing area) 220 (see FIG. 5) where toner is bore and the toner non-bearing areas (developer non-bearing area) 230 on the outer sides of the toner bearing area where the toner is not bore in the axial direction of the developing roller 401.

In other words, the wear amount of the CT layer in the first area 120 of the drum 100 to which the toner bearing area 220 of the developing roller 401 corresponds (see FIG. 5) and the wear amount of the CT layer in the second area 130 of the drum 100 to which the toner non-bearing area 230 corresponds are estimated. Then, the user is informed that the drum 100 has reached the end of its life by the display of the operation panel 21 when either the life threshold value of the total wear amount set in advance for the first area 120 or the life threshold value of the total wear amount set in advance for the second area 130 reaches the threshold value.

In calculating the total wear amount, it is necessary to determine the wear amount per unit time for each different condition. The time obtained by measuring the time under each condition while the image forming apparatus A is operating is multiplied by the wear amount per unit time which has been determined. Then, the total wear amount is obtained by integrating the result of the calculation of the wear amount in each condition. The total wear amount is compared with the threshold value.

The wear amount per unit time is mainly determined according to the condition regarding the amount of discharge when the developing roller 401 is separated from the drum 100 and the condition regarding the friction between the developing roller 401 and the drum 100 when the developing roller 401 contacts the drum 100.

According to the present exemplary embodiment, one-sided intermittent printing of three sheets of letter-size paper (width approximately 215.9 mm×length approximately 279.4 mm) is performed according to the sequence described above. The conditions that match the above-described conditions are the three conditions below. As the conditions where the amount of discharge is changed is when the printing is performed in the normal printing mode and when the forced full-surface exposure is performed in the monochrome mode. Regarding the rotation speed of the developing roller 401 in the contact state, since the speed of the developing roller 401 is not changed, there is only one condition.

Normally, the user prints a sheet at a print rate of a few percent if the print rate when the entire sheet surface is printed is regarded as 100%. Further, since the user does not frequently print a same pattern, the wear amount at normal printing is about the same as the wear when solid white printing is performed. Thus, when the image exposure is performed (F18, F18', F21, F21', F24, and F24' in FIG. 2 and F51, F54, and F57 in FIG. 3), the condition is determined as the same as the condition when the drum 100 is VD=−500 V.

Next, the wear amount per unit time under the three conditions described above is obtained from experiments below.

Condition 1: Rotate the drum 100 while the developing roller 401 is separated from the drum 100. Apply a charge bias of −1000 V to the charge roller 201 and a primary transfer bias of +300 V to the primary transfer roller 501.

Regarding the image forming apparatus A, according to a special experimental sequence, while the developing roller 401 was separated from the drum 100, a charge bias of −1000 V and a primary transfer bias of +300 V were applied at the same time the rotation of the drum 100 was started. The drum 100 was caused to continuously rotate in that state for six hours.

The film thickness of the drum 100 at the contact positions were measured by a film thickness measurement apparatus (PERMASCOPE: Fischer Technology, Inc.) before and after the experiment. The measurement positions are the center portion (the first area 120: the toner bearing area) and the end portions (the second areas 130: the toner non-bearing areas at the end portions) of the drum 100 in the longitudinal direction. The experiments under conditions 2 and 3 were also performed by continuously operating the image forming apparatus A for six hours and measuring the film thickness before and after the experiment as was performed for the condition 1.

Condition 2: Rotate the drum 100 while the developing roller 401 is separated from the drum 100. Apply a charge bias of −1000 V to the charge roller 201 and a primary transfer bias of −600 V to the primary transfer roller 501. Perform forced full-surface exposure.

Condition 3: Rotate the drum 100 while the developing roller 401 contacts the drum 100. Apply a charge bias of −1000 V to the charge roller 201 and a primary transfer bias of +300 V to the primary transfer roller 501.

The necessary film thickness of the CT layer in the first area 120 of the drum 100 was determined by an experiment. As a result of the experiment, when the thickness was less than 7 μm, especially in a high ambient temperature and humidity environment of 30 degrees C. 80% or greater, the drum 100 showed fast dark decay. Thus, due to a potential drop at the portion corresponding to the developing roller 401 after the application of the charge bias, the drum is unable to maintain appropriate contrast between the developing bias and the dark portion potential VD, and what is called fogging (toner is developed at the dark portion potential VD portion) occurs. According to the result of the experiment, the end-of-life film thickness was set to 7.0 μm. Further, the end-of-life film thickness of the second area 130 of the drum 100 was set to 0 μm.

<Film Thickness Measurement Result>

The wear amount (μm) and the calculation result of the wear amount per unit time (hereinafter referred to as a wear coefficient) after 6 hours under conditions 1 to 3 were as illustrated in Table 1.

TABLE 1

| | Toner bearing area | | Toner non-bearing area | |
|---|---|---|---|---|
| Condition | After 6 hours | Wear coefficient | After 6 hours | Wear coefficient |
| 1 | 3.34 μm | 0.000155 μm | 3.74 μm | 0.000173 μm |
| 2 | 3.64 μm | 0.000168 μm | 3.74 μm | 0.000173 μm |
| 3 | 3.34 μm | 0.000155 μm | 11.2 μm | 0.000520 μm |

Thus, by measuring the operation time under each condition and by multiplying the wear coefficient by the obtained time, the estimated wear amount under each condition can be obtained. In table 1, the toner bearing area denotes the first area 120 of the drum 100 and the toner non-bearing area denotes the second area 130 of the drum 100. These are the same with Tables 5 to 13 below.

The printing operation time under the above-described three conditions in the full-color mode and the monochrome mode are illustrated in Tables 2 to 4 below. Table 2 illustrates the operation time of the image forming stations Y, M, C, and K in the full-color mode. Table 3 illustrates the operation time of the image forming stations Y, M, and C in the monochrome mode. Table 4 illustrates the operation time of the image forming station K in the monochrome mode. Further, pre-rotation, inter-sheet, and post-rotation are defined as described below.

a: Pre-Rotation

The time of pre-rotation of the image forming stations Y, M, C, and K in the full-color mode corresponds to the time the charge bias is applied to the charge roller 201 before the developing roller 401 contacts the drum (F12 to F16 in FIG. 2). The time of pre-rotation of the image forming stations Y, M, and C in the monochrome mode corresponds to the time the charge bias is applied to the charge roller 201 before the start of the forced full-surface exposure is started (F42 to F49 in FIG. 3). The time of pre-rotation of the image forming station K in the monochrome mode corresponds to the time the charge bias is applied to the charge roller 201 before the developing roller 401 contacts the drum (F42 to F47 in FIG. 3).

b: Inter-Sheet

The time of inter-sheet of the image forming stations Y, M, C, and K in the full-color mode is in common with the time of inter-sheet of the image forming station K in the monochrome mode. The time of inter-sheet corresponds to the time the drum 100 rotates between pages while the developing roller 401 contacts the drum 100 (F19 to F20, F22 to F23 in FIG. 2 and F52 to F53, F55 to F56 in FIG. 3). When the image forming apparatus is in the monochrome mode, since the developing roller 401 of each of the image forming stations Y, M, and C is separated from the drum 100, there is no time corresponding to the inter-sheet.

c: Post-Rotation

The time of post-rotation of the image forming stations Y, M, C, and K in the full-color mode corresponds to the time the charge bias is applied to the charge roller 201 after the developing roller 401 is separated from the drum 100 (F28 to F29 in FIG. 2). The time of post-rotation of the image forming station K in the monochrome mode corresponds to the time the charge bias is applied to the charge roller 201 after the developing roller 401 is separated from the drum 100 (F63 to F65 in FIG. 3). As for the image forming stations Y, M, and C in the monochrome mode, since the forced full-surface exposure and the application of the charge bias to the charge roller 201 are simultaneously turned off, there is no time corresponding to the post-rotation.

Further, regarding the time of "image forming+inter-sheet" under condition 3 in Table 2, in addition to the time for image forming of three pages, inter-sheet of the first page to the second page, and inter-sheet of the second page to the third page, the time described below is added.

The time of "image forming+inter-sheet" in Table 2 will be described in detail. The developing rollers 401 of the image forming stations Y, M, C, and K contact the drum 100 at the same time and are also separated from the drum 100 at the same time. Thus, for example, the developing roller 401 of the image forming station Y is separated from the drum 100 after the yellow image of the third page is conveyed by a distance of three station-to-station distances (Y and M, M and C, C and K) on the belt 502 from the image forming station Y to the image forming station K.

On the other hand, at the image forming station K, the black image is primary transferred when the yellow image of the first page which has been primary transferred at the image forming station Y passes the third station-to-station distance and reaches the image forming station K. This means that it is necessary to add the time necessary for conveying an image for a distance corresponding to three station-to-station distances to the contact time of the developing roller 401 of each of the image forming stations Y, M, C, and K. According to the present exemplary embodiment, it is 2.01 seconds (=3×(67 mm/100 mm/sec)).

On the other hand, in the monochrome mode, the developing roller 401 of each of the image forming stations Y, M, and C does not contact the drum 100 (F48). The developing roller 401 of the image forming station K contacts the drum 100 just before the transfer of the toner of the first page is performed (F47) and separates immediately after the transfer of the toner of the third page is performed (F63). Since the developing roller 401 of the image forming station K does not need to wait for the image forming performed by other image forming stations, it is not necessary to add the time necessary for an image to be conveyed the station-to-station distances.

According to the present exemplary embodiment, the life threshold value SC of the first area 120, which is 8 μm (=initial film thickness 15 μm−end-of-life film thickness 7 μm) and the life threshold value SE of the second area 130, which is 15 μm (=initial film thickness 15 μm−end-of-life film thickness 0 μm) are stored in the memory 15.

Further, the wear coefficients of the conditions in Table 5 are stored in the memory 15. Alphanumeric characters within parentheses in Table 5 are the names provided for the wear coefficient under each condition.

TABLE 2

| Full color mode: YMCK | | | | | | | | |
|---|---|---|---|---|---|---|---|---|
| Pre-rotation | | Image forming + inter-sheet (image: 3 pages + inter-sheet: 2 times + station-to-station distance: 3) | | Post rotation | | Total time (sec) | | |
| Condition | Rotation time (sec) | Condition | Rotation time (sec) | Condition | Rotation time (sec) | Condition 1 | Condition 2 | Condition 3 |
| 1 | 4.3 | 3 | 11.372 | 1 | 6.5 | 10.8 | 0 | 11.372 |

TABLE 3

| Monochrome mode: YMC | | | | | | |
|---|---|---|---|---|---|---|
| Pre-rotation | | Forced full-surface exposure | | Total time (sec) | | |
| Condition | Rotation time (sec) | Condition | Rotation time (sec) | Condition 1 | Condition 2 | Condition 3 |
| 1 | 6.31 | 2 | 15.862 | 6.31 | 15.862 | 0 |

TABLE 4

| Monochrome mode: K | | | | | | | | |
|---|---|---|---|---|---|---|---|---|
| Pre-rotation | | Image forming + inter-sheet (image: 3 pages + inter-sheet: 2 times) | | Post rotation | | Total time (sec) | | |
| Condition | Rotation time (sec) | Condition | Rotation time (sec) | Condition | Rotation time (sec) | Condition 1 | Condition 2 | Condition 3 |
| 1 | 6.31 | 3 | 9.362 | 1 | 6.5 | 12.81 | 0 | 9.362 |

Next, a drum life estimation calculation unit and a life informing determination method according to the present exemplary embodiment will be described with reference to a block diagram and a flowchart.

As illustrated in FIG. 1A, the memory 15 is provided in each of the process cartridges YC, MC, CC, and KC of corresponding colors. A plurality of threshold values associated with the wear amounts of a plurality of different portions of the CT layer (organic photosensitive layer) of the drum 100 is stored in the memory 15. According to the present exemplary embodiment, a life threshold value SC associated with the wear amount of the first area 120 of the drum 100 corresponding to the toner bearing area 220 of the developing roller 401 and a life threshold value SE associated with the wear amount of the second area 130 corresponding to the toner non-bearing area 230 are stored in the memory 15.

TABLE 5

| Condition | Toner bearing area Wear coefficient | Toner non-bearing area Wear coefficient |
|---|---|---|
| 1 | 0.000155 μm (cc1) | 0.000173 μm (ec1) |
| 2 | 0.000168 μm (cc2) | 0.000173 μm (ec2) |
| 3 | 0.000155 μm (cc3) | 0.000520 μm (ec3) |

Furthermore, a total wear amount, which is the result calculated by a total wear amount calculation unit 19*b* described below, is stored in the memory 15. There are two types of total wear amount. One is the total wear amount "SCn" of the toner bearing area and the other is the total wear amount "SEn" of the toner non-bearing area end portion.

The control unit 1000 includes the photosensitive drum life estimation unit 16 as an image bearing member life estimation unit. The photosensitive drum life estimation unit 16 is included in the control unit 1000 as a photosensitive drum life determination function unit (image bearing member life determination function unit).

Further, the photosensitive drum life estimation unit 16 includes a wear condition detection unit 17, a time measurement unit 18, a wear amount calculation unit 19*a*, the total wear amount calculation unit 19*b*, and a comparison unit 20. The wear condition detection unit 17 determines the rotation of the drum and also detects a charge bias application value, a primary transfer bias value, an exposure amount of the image exposure unit, and whether the developing roller contacts (or is separated from) the drum 100.

The photosensitive drum life estimation unit 16 determines whether the state of the image forming apparatus A matches any of the above-described conditions 1 to 3. The time measurement unit 18 calculates the time under each of the conditions 1 to 3. The wear amount calculation unit 19*a* calculates the wear amount by multiplying the measurement result obtained by the time measurement unit 18 by the wear coefficient of each condition stored in the memory 15. This calculation is performed each time the operation in each condition ends. The total wear amount calculation unit 19*b* newly adds the value calculated by the wear amount calculation unit 19*a* to the integrated wear amount. The comparison unit 20 compares the result of the calculation performed by the total wear amount calculation unit 19*b* and the life threshold value stored in the memory 15 and determines whether the total wear amount is equal to or greater than the life threshold value.

Figure 4:
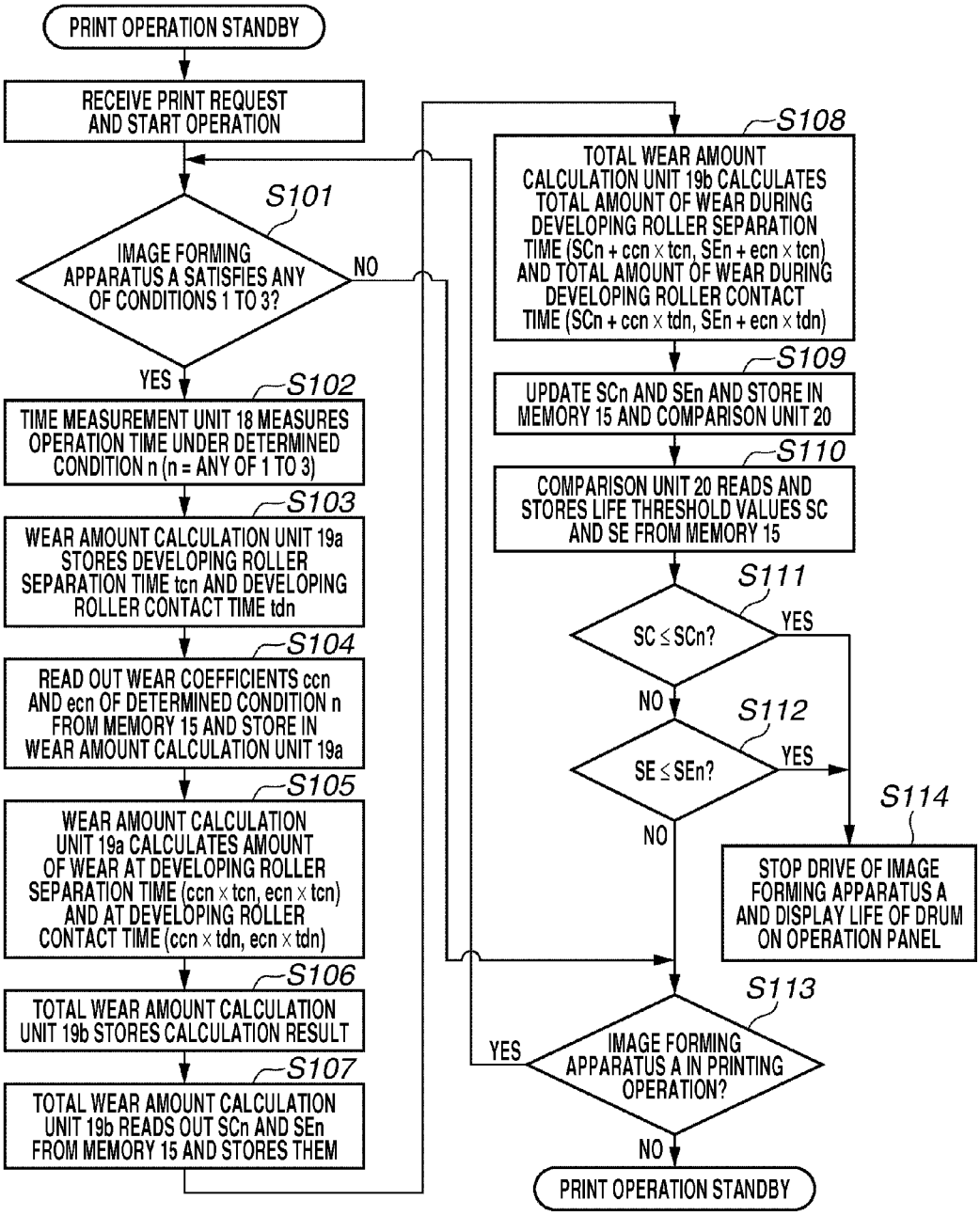
FIG. 4 is a flowchart illustrating determination of a life of a photosensitive drum.

Next, the calculation of the wear amount and the life estimation performed by the photosensitive drum life estimation unit 16 will be described with reference to a flowchart in FIG. 4. Referring to FIG. 4, the operation of the photosensitive drum life estimation unit 16 which is started when the image forming apparatus A, which is in the print operation standby state, receives a print request, will be described in detail. Whether the image forming apparatus A described below is performing the printing operation is determined based on whether the charge roller 201 is performing discharge. The discharge of the charge roller 201 is determined based on a charge current detection circuit implemented in a charge bias application circuit (not illustrated) detecting the charge current.

In step S101, the wear condition detection unit determines whether the image forming apparatus A satisfies any of the conditions 1 to 3. If the image forming apparatus A satisfies any of the conditions 1 to 3 (YES in step S101), the processing proceeds to step S102. If the image forming apparatus A does not satisfy any of the conditions 1 to 3 (NO in step S101), the processing proceeds to step S113.

In step S102, the time measurement unit 18 measures the length of time of the operation of the image forming apparatus A under a condition n (n=numerical value of any one of 1 to 3) determined in step S101. In step S103, the time measurement unit 18 stores the obtained length of time in the wear amount calculation unit 19*a*. The obtained length of time is stored as "tcn" if the developing roller 401 is separated from the drum 100 and stored as "tdn" if the developing roller 401 contacts the drum 100.

In step S104, wear coefficients "ccn" and "ecn" of the detected condition n are read out from the memory 15 and stored in the wear amount calculation unit 19*a*.

In step S105, the wear amount calculation unit 19*a* calculates ccn×tcn and ecn×tcn as the wear amount of the drum 100 that occurs when the developing roller 401 is separated from the drum 100. Further, the wear amount calculation unit 19*a* calculates ccn×tdn and ecn×tdn as the wear amount of the drum 100 that occurs when the developing roller 401 contacts the drum 100. In step S106, the calculation results are stored in the total wear amount calculation unit 19*b*.

In step S107, the total wear amount calculation unit 19*b* reads out the total wear amounts SCn and SEn from the memory 15 and stores them.

In step S108, the total wear amount calculation unit 19*b* calculates SCn+ccn×tcn and SEn+ecn×tcn as the total wear amount when the developing roller 401 is separated from the drum 100. The total wear amount calculation unit 19*b* calculates SCn+ccn×tdn and SEn+ecn×tdn as the total wear amount when the developing roller 401 contacts the drum 100. In step S109, SCn and SEn are updated using the result of the calculation and the updated SCn and SEn are stored in the memory 15 and the comparison unit 20.

In step S110, the comparison unit 20 reads out the life threshold values SC and SE from the memory 15 and stores them.

In step S111, the comparison unit 20 determines whether SC≤SCn. If SC≤SCn (YES in step S111), the processing proceeds to step S114. If SC>SCn (NO in step S111), the processing proceeds to step S112.

In step S112, the comparison unit 20 determines whether SE SEn. If SE SEn (YES in step S112), the processing proceeds to in step S114. If SE>SEn (NO in step S112), the processing proceeds to in step S113.

In step S113, the image forming apparatus A does not inform the user that the life of the photosensitive drum is nearing its end and determines whether the image forming apparatus A is performing the printing operation. If the image forming apparatus A is performing the printing operation (YES in step S113), the processing returns to S101. If the image forming apparatus A is not performing the printing operation (NO in step S113), the state of the image forming apparatus A is changed to the standby state.

In step S114, the image forming apparatus A gradually stops the drive operation and the bias application and displays a message on the operation panel 21 informing the user that the drum is nearing the end of its life.

By using the above-described photosensitive drum life estimation mechanism, the drum life in number of pages, the life determination area (the first area 120 or the second area 130), the total wear amount of the image forming apparatus A were determined in each of the sheet-passing modes described below.

sheet-passing mode 1: full-color mode only sheet-passing mode 2: monochrome mode only sheet-passing mode 3: after printing 2700 pages in full-color mode, change the mode to monochrome mode and perform printing Endurance test was performed by intermittently printing three sheets of letter-size paper in all of the above-described three sheet-passing modes.

The life of the drum 100 according to the present exemplary embodiment in the full-color mode is set to 5781 pages for the drum 100 of each of the image forming stations Y, M, C, and K. The life of the drum 100 in the monochrome mode is set to 6588 pages for the drum 100 of each of the image forming stations Y, M, and C and set to 6351 pages for the drum 100 of the image forming station K.

The results of the tests in the sheet-passing modes 1 and 2 are illustrated in Tables 6 and 7. The result of the test in the sheet-passing mode 3 is illustrated in Tables 8 to 10. Each of the numerical values within parentheses in Tables 8 to 10 indicates the integrated wear amount. In other words, 100% indicates that the wear has reached the life threshold value.

TABLE 6

| Sheet-passing mode 1 | | | | | |
|---|---|---|---|---|---|
| | | | | Wear amount at end of life | |
| Cartridge | Life pages | Life determination area | Total wear amount in life determination area | Toner bearing area SCn | Toner non-bearing area SEn |
| Y | 5781 | Toner non-bearing area | 15.0 μm | 6.62 μm | 15.0 μm |
| M | 5781 | Toner non-bearing area | 15.0 μm | 6.62 μm | 15.0 μm |
| C | 5781 | Toner non-bearing area | 15.0 μm | 6.62 μm | 15.0 μm |
| K | 5781 | Toner non-bearing area | 15.0 μm | 6.62 μm | 15.0 μm |

TABLE 7

| Sheet-passing mode 2 | | | | | |
|---|---|---|---|---|---|
| | | | | Wear amount at end of life | |
| Cartridge | Life pages | Life determination area | Total wear amount in life determination area | Toner bearing area SCn | Toner non-bearing area SEn |
| Y | 6588 | Toner bearing area | 8.0 μm | 8.00 μm | 8.42 μm |
| M | 6588 | Toner bearing area | 8.0 μm | 8.00 μm | 8.42 μm |
| C | 6588 | Toner bearing area | 8.0 μm | 8.00 μm | 8.42 μm |
| K | 6351 | Toner non-bearing area | 15.0 μm | 7.27 μm | 15.0 μm |

TABLE 8

| Sheet-passing mode 3 | | |
|---|---|---|
| | Full-color mode (after printing 2700 pages) | |
| Cartridge | Toner bearing area SCn (SCn/SC × 100) | Toner non-bearing area SEn (SEn/SE × 100) |
| Y | 3.09 μm (38.6%) | 7.00 μm (46.7%) |
| M | 3.09 μm (38.6%) | 7.00 μm (46.7%) |
| C | 3.09 μm (38.6%) | 7.00 μm (46.7%) |
| K | 3.09 μm (38.6%) | 7.00 μm (46.7%) |

TABLE 9

| After mode change to monochrome mode | | | |
|---|---|---|---|
| Cartridge | Number of printable pages to life in monochrome mode | Life determination area | Total wear amount in life determination area |
| Y | 4044 | Toner bearing area | 8.0 μm |
| M | 4044 | Toner bearing area | 8.0 μm |
| C | 4044 | Toner bearing area | 8.0 μm |
| K | 3387 | Toner non-bearing area | 15.0 μm |

TABLE 10

| Wear amount at end of life | | |
|---|---|---|
| Cartridge | Toner bearing area SCn (SCn/SC × 100) | Toner non-bearing area SEn (SEn/SE × 100) |
| Y | 8.00 μm (100%) | 12.17 μm (81.1%) |
| M | 8.00 μm (100%) | 12.17 μm (81.1%) |
| C | 8.00 μm (100%) | 12.17 μm (81.1%) |
| K | 6.97 μm (87.1%) | 15.00 μm (100%) |

According to the above-described endurance tests, the end of the drum life in the full-color mode only and the end of the drum life in the monochrome mode only are correctly informed. Further, in the full-color printing in the sheet-passing mode 3, even if the wear at the end portion of the second area 130 of the drum 100 is significant, after the mode is changed to the monochrome mode, the wear in the first area 120 reaches the threshold value before the end portion of the second area 130.

Further, when the drum 100 has reached the end of its life, regarding the wear amount in the first area 120 of the drum 100 of the image forming station K in Tables 6 and 7, the wear amount in the sheet-passing mode 2 (monochrome mode) illustrated in Table 7 is greater than the wear amount in the sheet-passing mode 1 (full-color mode) illustrated in Table 6. This is because the contact time of the developing roller 401 of the image forming station K in the monochrome mode is short. That is, since the contact time of the developing roller 401 is short, the wear amount in the first area 120 takes longer time before the wear reaches the life threshold value.

Thus, since the wear amount in the first area 120 increases, the wear amount when the drum has reached the end of its life also increases. For example, if small size paper of a size smaller than the letter size is printed, by changing the contact timing of the developing roller 401 that matches the small size paper, the contact time of the developing roller 401 can be reduced.

In such a case, although the drum 100 may reach the end of its life according to the wear in the first area 120 depending on the paper size, the life can be appropriately informed regardless of the contact time of the developing roller 401, according to the photosensitive drum life estimation mechanism of the present invention.

According to the present exemplary embodiment, although the threshold value of the integrated wear amount is used as the life threshold value, the minimum film thickness (first area: 7 μm, end portions of second area: 0 μm) may also be set as the threshold value. In such a case, the wear amount is subtracted from the initial film thickness of 15 μm. When the result of the calculation reaches the minimum film thickness, the user may be informed that the drum has reached the end of its life.

Further, as described above, according to the conventional technique, the life is not determined according to different positions in the longitudinal direction of the drum. As can be seen from the results of the endurance tests of the present exemplary embodiment, if the drum is determined that it has reached the end of its life when the wear in the first area 120 reaches 8 μm, for example, the wear at the end portions of the second area 130 may be 15 μm or greater in the full-color mode (Table 6) before the wear in the first area 120 reaches 8 μm. Accordingly, the risk of leakage is increased. Further, if the drum is determined that it has reached the end of its life when the wear at the end portions of the second area 130 reaches 15 μm, in the case of the sheet-passing mode 3, the wear in the first area 120 exceeds 8 μm (Tables 9 and 10) in the monochrome mode and the risk of fogging at a high ambient temperature and humidity environment becomes higher.

According to the present exemplary embodiment, three conditions are extracted for the amount of discharge condition of the charge when the developing roller is separated from the drum and the condition of friction between the developing roller and the drum when the developing roller contacts the drum, and the wear coefficient is obtained for each of the three conditions. The condition regarding the wear is not limited to the conditions described in the present exemplary embodiment. For example, if the potential of the drum before it is charged is changed due to change in exposure or primary transfer bias, the wear coefficient can be obtained for each condition which has been changed.

Further, regarding the friction conditions of the drum, if the speed of the developing roller or the amount of depression is changed, the wear coefficient can be obtained for each of such conditions. Further, if a contact condition or the speed of a member that contacts the drum other than the developing roller, such as the intermediate transfer belt, is changed, the wear coefficient can be obtained for each condition that has been changed.

Further, according to the present exemplary embodiment, the wear amount is estimated at two portions of the drum in the longitudinal direction. However, if there are more than two portions where the wear is obvious on the drum in the longitudinal direction, the wear amount can be estimated using a threshold value of an additional point.

Thus, by using the photosensitive drum life estimation mechanism of the present invention, the user can effectively use the drum until the end of its life.

The features of the image forming apparatus A according to the first exemplary embodiment described above are as follows. A plurality of different portions of the CT layer of the drum 100 includes the first area 120 corresponding to the toner bearing area 220 of the developing roller 401 which bears toner in the axial direction and the second areas 130 corresponding to the toner non-bearing areas 230 at outer sides of both sides of the toner bearing area 220. The image forming apparatus A also includes a development device contact/separation mechanism 22 used for the contact/separation of the developing roller 401 with the drum 100. The memory 15 stores items 1) to 5) below.

1) The memory 15 stores the threshold value SC associated with the wear amount in the first area 120 and the threshold value SE associated with the wear amount in the second area 130.

2) The memory 15 also stores the wear amount of the CT layer per predetermined unit time under various conditions (a number n of conditions (n≥1)) where the amount of discharge of the process unit, which acts on the drum 100, to the drum 100 is different, in a state where the developing roller 401 is separated from the drum 100. The wear amount of the CT layer per predetermined unit time under each of the various conditions regarding the first area 120 is stored in the memory 15 as cc1, cc2, . . . ccn. The amount of discharge to the drum 100 of the process unit that acts on the drum 100 is the amount of discharge of the condition of the charge bias applied to the charge roller 201 and the exposure condition after the application of the charge.

3) The wear amount of the CT layer per predetermined unit time under each of the various conditions regarding the second area 130 is stored as ec1, ec2, . . . ecn in the memory 15.

4) The wear amount of the CT layer per predetermined unit time under each of the various conditions in a state where the developing roller 401 contacts the drum 100 is stored in the memory 15. Regarding the first area 120, the wear amount of the CT layer per predetermined unit time under various conditions is stored as cd1, cd2, . . . cdn in the memory 15.

5) Regarding the second area 130, the wear amount of the CT layer per predetermined unit time under each of the various conditions is stored as ed1, ed2, . . . edn in the memory 15.

The photosensitive drum life estimation unit 16 measures tc1, tc2, . . . tcn which are times respectively associated with the various conditions in a state where the developing roller 401 is separated from the drum 100. Further, the photosensitive drum life estimation unit 16 measures td1, td2, . . . tdn which are times respectively associated with the various conditions when the developing roller 401 contacts the drum 100.

Further, the total wear amount SCn and the total wear amount SEn which are the total wear amounts in the first area 120 and the second area 130 are calculated as illustrated below using the measured time and the wear amount per predetermined unit time under each of the various conditions.

$$SCn=\Sigma(cci\times tci+cdi\times tdi) \text{ where } i=1 \text{ to } n$$

$$SEn=\Sigma(eci\times tci+edi\times tdi) \text{ where } i=1 \text{ to } n$$

The threshold value SC and the threshold value SE are compared and if the total wear amount SCn is equal to or greater than the threshold value SC or the total wear amount SEn is equal to or greater than the threshold value SE, it is determined that the drum 100 has reached the end of its life.

According to a second exemplary embodiment, since the configurations and the operations of the image forming apparatus are same as those of the first exemplary embodiment except for the initial film thickness of the CT layer of the drum 100, only the effect of the difference in the initial film thickness of the CT layer to the drum life will be described.

According to the second exemplary embodiment, a drum with the CT layer having a film thickness of 13 μm is used as the drum 100. When the film thickness is 13 μm, the life threshold value SC of the first area 120 is 6 μm (=initial film thickness 13 μm−end-of-life film thickness 7 μm) and the life threshold value SE of the second area 130 is 13 μm (=initial film thickness 13 μm−end-of-life film thickness 0 μm). These values are stored in the memory 15 as SC and SE.

By using the photosensitive drum life estimation mechanism described in the first exemplary embodiment, the drum life in number of pages, the life determination area (the first area 120 or the second area 130), the total wear amount of the image forming apparatus A were determined in the sheet-passing modes 1 and 2 as is performed in the first exemplary embodiment.

The life of the drum 100 according to the present exemplary embodiment in the full-color mode is set to 5010 pages for the drum 100 of each of the image forming stations Y, M, C, and K. The life of the drum 100 in the monochrome mode is set to 4941 pages for the drum 100 of each of the image forming stations Y, M, and C and set to 5235 pages for the drum 100 of the image forming station K. The results determined in the sheet-passing modes 1 and 2 are shown in Tables 11 and 12 below.

TABLE 11

| Sheet passing mode 1 | | | | | |
|---|---|---|---|---|---|
| | | | | Wear amount at end of life | |
| Cartridge | Life (pages) | Life determination area | Total wear amount in life determination area | Toner bearing area SCn | Toner non-bearing area SEn |
| Y | 5010 | Toner non-bearing area | 13.0 μm | 5.74 μm | 13.0 μm |
| M | 5010 | Toner non-bearing area | 13.0 μm | 5.74 μm | 13.0 μm |
| C | 5010 | Toner non-bearing area | 13.0 μm | 5.74 μm | 13.0 μm |
| K | 5010 | Toner non-bearing area | 13.0 μm | 5.74 μm | 13.0 μm |

TABLE 12

| Sheet passing mode 2 | | | | | |
|---|---|---|---|---|---|
| | | | | Wear amount at end of life | |
| Car-tridge | Life (pages) | Life determination area | Total wear amount in life determination area | Toner bearing area SCn | Toner non-bearing area SEn |
| Y | 4941 | Toner bearing area | 6.0 μm | 6.00 μm | 6.31 μm |
| M | 4941 | Toner bearing area | 6.0 μm | 6.00 μm | 6.31 μm |
| C | 4941 | Toner bearing area | 6.0 μm | 6.00 μm | 6.31 μm |
| K | 5235 | Toner bearing area | 6.0 μm | 6.00 μm | 12.36 μm |

According to the result of the sheet-passing mode 1 illustrated in Table 11, as is shown in Table 6 according to the first exemplary embodiment, each drum of all the image forming stations has reached the end of its life in the second area 130. However, the total wear amount of the first area 120 is very close to the life threshold value 6 μm. Further, according to the result of the sheet-passing mode 2 illustrated in Table 12, unlike the Table 7 according to the first exemplary embodiment, the drum of the black image forming station also has reached the end of its life in the first area 120.

Figure 6:
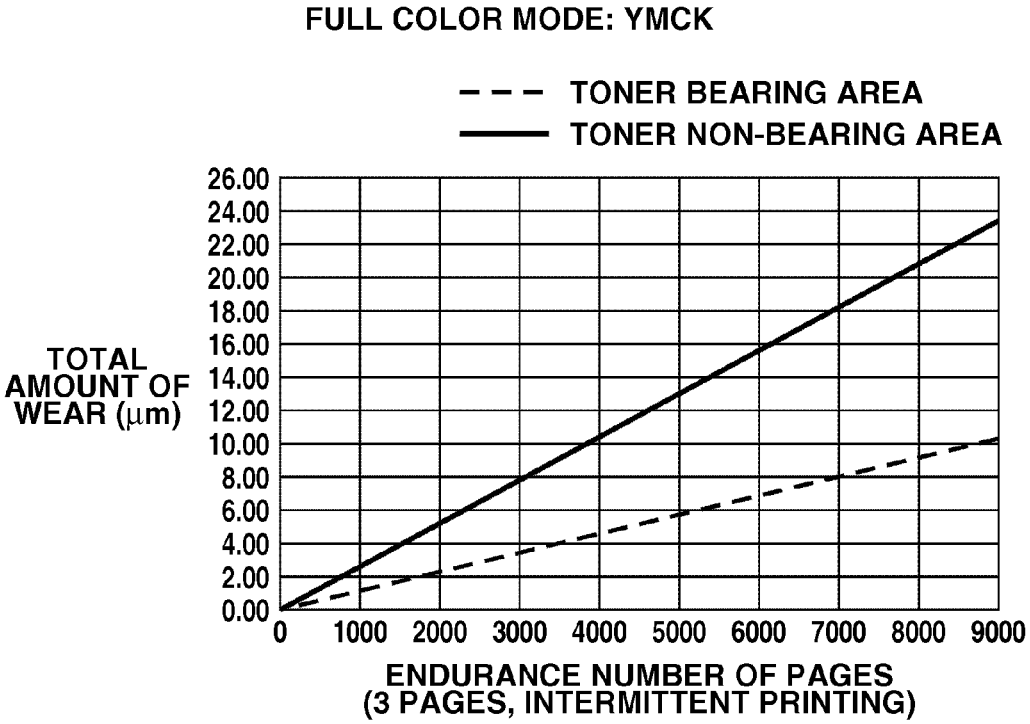
FIG. 6 is a graph illustrating a relation between a total wear amount and a printable number of sheets in the full-color mode according to a second exemplary embodiment.
Figure 7:
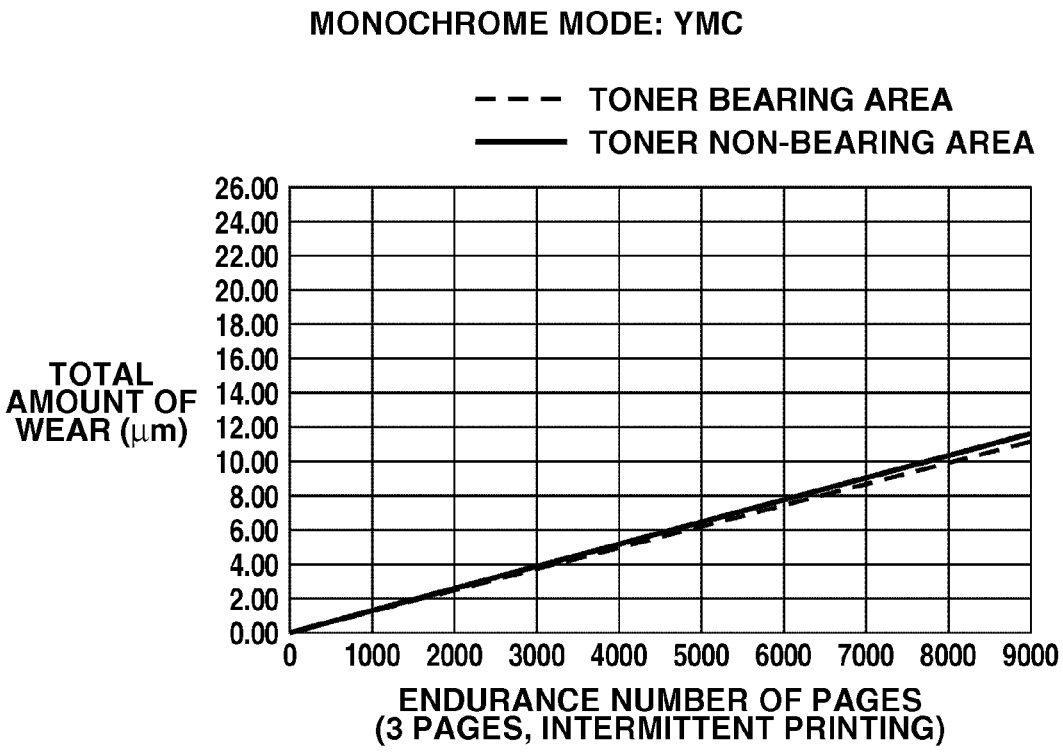
FIG. 7 is a graph illustrating a relation between a total wear amount and a printable number of sheets in the monochrome mode according to the second exemplary embodiment.

These results will be described with reference to FIGS. 6 to 8. FIG. 6 is a graph illustrating a relation between the endurance number of pages and the total wear amount of the drum 100 of each of the image forming stations Y, M, C, and K when the intermittent printing of three pages in the full-color mode which corresponds to the sheet-passing mode 1 is performed. FIG. 7 is a graph illustrating a relation between the endurance number of pages and the total wear amount of the drum 100 of each of the image forming stations Y, M, and C when intermittent printing of three pages in the monochrome mode which corresponds to the sheet-passing mode 2 is performed.

Figure 8:
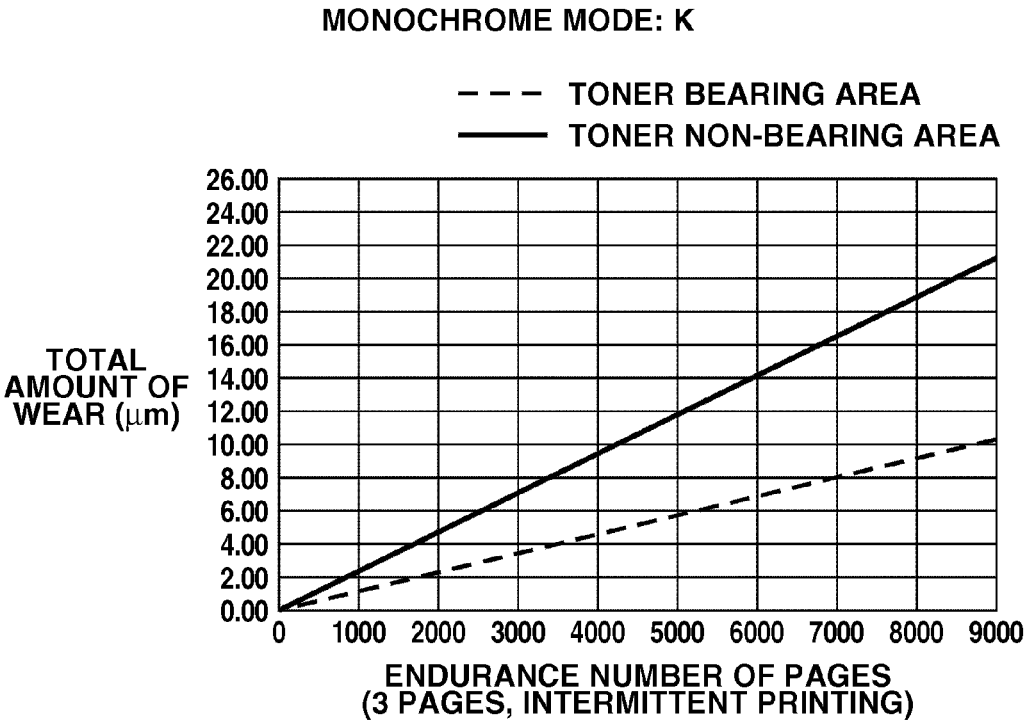
FIG. 8 is a graph illustrating a relation between a total wear amount and a printable number of sheets in the monochrome mode according to the second exemplary embodiment.

FIG. 8 is a graph illustrating a relation between the endurance number of pages and the total wear amount of the drum 100 of the image forming station K when the intermittent printing of three pages in the monochrome mode which corresponds to the sheet-passing mode 2 is performed. FIGS. 6 to 8 illustrate transitions of the total wear amount in the first area 120 (toner bearing area) and the second area 130 (end portion of the toner non-bearing area).

In FIGS. 6 and 8, the difference between the total wear amount of the first area 120 and the total wear amount of the second area 130 is significant. In FIG. 7, since the developing roller 401 does not contact the drum 100 and the wear amount of the first area 120 is increased by the forced full-surface exposure, the difference is small.

Next, in order to verify the fact that the drum of the image forming station K has reached the end of its life in different areas in Tables 11 and 12, the initial film thickness when the life determination area is changed from the first area 120 to the end portion of the second area 130 in the full-color mode and the monochrome mode is obtained.

Table 13 illustrates the total wear amount for three pages in the full-color mode and in the monochrome mode. In Table 13, the ratio of the total wear amount at the end portion of the second area 130 with respect to the first area 120 is given in the field of Ratio.

TABLE 13

| Endurance mode | Cartridge | Toner bearing area | Toner non-bearing area end portion | Ratio |
|---|---|---|---|---|
| Full color mode | YMCK | 0.003437 μm | 0.007782 μm | 2.26 |
| Monochrome mode | YMC | 0.003643 μm | 0.003836 μm | 1.05 |
| | K | 0.003437 μm | 0.007084 μm | 2.06 |

In the expressions below, y denotes the initial film thickness (μm) and x denotes the total wear amount (μm) in the first area 120. The life threshold value of the film thickness of the first area 120 is 7 μm. Thus, if the apparatus is operated in the full color mode, since the ratio is 2.26, the following expressions are calculated.

The first area 120: $7=y-x$

End portion of the second area 130: $y=2.26x$

From these equations, x=5.56 μm and y=12.55 μm. Thus, if the initial film thickness exceeds 12.55 μm, the drum reaches the end of its life at the end portion of the second area 130. If the initial film thickness is less than 12.55 μm, the drum reaches the end of its life in the first area 120.

Similarly, in the case of the monochrome mode, since the ratio is 2.06, the expressions below are calculated.

The first area 120: $7=y-x$

End portion of the second area 130: $y=2.06x$

From these equations, x=6.60 μm and y=13.60 μm. Thus, if the initial film thickness exceeds 13.60 μm, the drum reaches the end of its life at the end portion of the second area 130. If the initial film thickness is less than 13.60 μm, the drum reaches the end of its life in the first area 120.

As can be seen from the result of the calculation above, since the initial film thickness is 13 μm according to the second exemplary embodiment, the end portion of the second area 130 is within the film thickness area where the wear reaches the threshold value in the full-color mode and each of all the drums has reached the end of its life at the end portion of the second area 130. However, in the monochrome mode, the first area 120 is within the film thickness area where the wear reaches the threshold value. Thus, the drum reached the end of its life in the first area 120.

As described above, even if a drum having a different initial film thickness of the CT layer is used, the user can effectively use the photosensitive drum to the end of its life by using the photosensitive drum life estimation mechanism according to the present invention.

The features of the image forming apparatus A according to the second exemplary embodiment described above are as follows. A plurality of different portions of the CT layer of the drum 100 includes the first area 120 corresponding to the toner bearing area 220 of the developing roller 401 which carries toner in the axial direction and the second areas 130 corresponding to the toner non-bearing areas 230 at outer sides of both sides of the toner bearing area 220. The image forming apparatus A also includes a development device contact/separation mechanism 22 used for the contact/separation of the developing roller 401 with the drum 100. The memory 15 stores items 1) to 6) below.

1) The memory 15 stores a film thickness SCI of the CT layer in the first area 120 and a film thickness SEI of the CT layer in the second area 130 when the drum 100 is in the unused state.

2) The memory 15 stores an end-of-life film thickness SCE of the first area 120 and an end-of-life film thickness SEE of the second area 130.

3) The memory 15 also stores the wear amount of the CT layer per predetermined unit time under various conditions (a number n of conditions ($n \geq 1$)) where the condition of the process unit that acts on the drum 100 is different, in a state where the developing roller 401 is separated from the drum 100. The wear amount of the CT layer per predetermined unit time under each of the various conditions regarding the first area 120 is stored in the memory 15 as cc1, cc2, . . . ccn. The condition of the process unit that acts on the drum 100 is the condition of the charge bias applied to the charge roller 201 and the exposure condition after the application of the charge.

4) The wear amount of the CT layer per predetermined unit time under each of the various conditions regarding the second area 130 is stored as ec1, ec2, . . . ecn in the memory 15.

5) The wear amount of the CT layer per predetermined unit time under each of the various conditions in a state where the developing roller 401 contacts the drum 100 is stored in the memory 15. Regarding the first area 120, the wear amount per predetermined unit time under various conditions is stored as cd1, cd2, . . . cdn in the memory 15.

6) Regarding the second area 130, the wear amount of the CT layer per predetermined unit time under each of the various conditions is stored as ed1, ed2, . . . edn in the memory 15.

The photosensitive drum life estimation unit 16 measures tc1, tc2, . . . tcn which are times respectively associated with the various conditions in a state where the developing roller 401 is separated from the drum 100. Further, the photosensitive drum life estimation unit 16 measures td1, td2, . . . tdn which are times respectively associated with the various conditions when the developing roller 401 contacts the drum 100.

Further, the total wear amount SCn and the total wear amount SEn which are the total wear amounts in the first area 120 and the second area 130 are calculated using the measured time and the wear amount per predetermined unit time under each of the various conditions as illustrated below.

$$SCn=\Sigma(cci\times tci+cdi\times tdi) \text{ where } i=1 \text{ to } n$$

$$SEn=\Sigma(eci\times tci+edi\times tdi) \text{ where } i=1 \text{ to } n$$

Further, a difference SCr and a difference SEr are calculated from the film thickness SCI and the film thickness SEI when the drum 100 is in the unused state and the total wear amount SCn and the total wear amount SEn which have been calculated.

$$SCr=SCI-SCn,$$

$$SEr=SEI-SEn$$

Then, the difference SCr and the end-of-life film thickness SCE and the difference SEr and the end-of-life film thickness SEE are compared.

If the difference SCr is equal to or less than the value of the end-of-life film thickness SCE, or the difference SEr is equal to or less than the value of the end-of-life film thickness SEE, it is determined that the drum 100 has reached the end of its life.

Regarding the image forming apparatus A of the first and the second exemplary embodiments, an image forming apparatus which uses a transfer belt, as a recording material conveyance member which bears and conveys the recording material 900, in place of the belt 502, can be used. Then, a toner image formed on the drum 100 can be directly transferred to the recording material 900 which is bore and conveyed by the transfer belt. The present invention can be applied to such an image forming apparatus and a similar effect can be obtained.

Further, the image forming apparatus may be a monochromatic image forming apparatus which performs image forming of a single color. Even if the apparatus is different from the image forming apparatus described in the exemplary embodiments, a similar effect can be obtained so long as the apparatus has a plurality of image forming execution modes having different wear amounts of CT layer in an area where image forming of the image bearing member is performed and in an area where image forming is not performed. As the plurality of image forming execution modes, there is, for example, a plurality of image forming execution modes of different processing speeds or different numbers of recording material.

According to the present invention, an image forming apparatus which is capable of effectively using the image bearing member to the end of its life can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-154479 filed Jul. 10, 2012, which is hereby incorporated by reference herein in its entirety.

What is claimed is:

1. An image forming apparatus comprising:

a rotatable image bearing member having an organic photosensitive layer on a surface;

a charging member configured to contact and charge the surface of the image bearing member;

an exposure unit configured to form a latent image by exposing the surface of the charged image bearing member to light;

a development device including a developer bearing member configured to cause a developer bearing member bearing developer to contact the surface of the image bearing member, and convey the developer to develop the latent image;

a cleaning member configured to contact the surface of the image bearing member and clean the surface of the image bearing member;

a storage unit configured to store a first threshold of a first wear amount of a first area of the organic photosensitive layer and a second threshold of a second wear amount of a second area of the organic photosensitive layer; and an image bearing member life estimation unit configured to estimate the first and second wear amounts, compare the first and second wear amounts and the first and second thresholds, and send out a message informing that the image bearing member has reached the end of its life if any of the first and second wear amounts reaches a respective threshold, wherein the organic photosensitive layer includes a first area and a second area which is different from the first area, wherein the first and second wear amounts are determined based on a measured length of time of contact between the image bearing member and the developer bearing member and a measured length of time of separation between the image bearing member and the developing bearing member.

2. The image forming apparatus according to claim 1, wherein the plurality of different portions of the organic photosensitive layer includes the first area corresponding to a developer bearing area bearing the developer in an axial direction of the developer bearing member and the second area corresponding to a developer non-bearing area not bearing the developer at outer sides of both ends of the developer bearing area.

3. The image forming apparatus according to claim 1, further comprising a development device contact/separation mechanism configured to cause the developer bearing member to contact the image bearing member and separate the developer bearing member from the image bearing member.

4. The image forming apparatus according to claim 1, further comprising a development device contact/separation mechanism configured to cause the developer bearing member to contact the image bearing member and separate the developer bearing member from the image bearing member, wherein the plurality of different portions of the organic photosensitive layer includes the first area corresponding to a developer bearing area bearing the developer in an axial direction of the developer bearing member and the second area corresponding to a developer non-bearing area not bearing the developer at outer sides of both ends of the developer bearing area, and wherein the storage unit stores:

1) a threshold value SC associated with the wear amount in the first area and a threshold value SE associated with the wear amount in the second area, 2) the wear amount of the organic photosensitive layer per predetermined unit time under each of various conditions (a number n of conditions (n≥1)) where an amount of discharge of a process unit, which acts on the image bearing member, to the image bearing member is different, when the developer bearing member is separated from the image bearing member, as cc1, cc2, . . . ccn for the first area 3) ec1, ec2 . . . ecn for the second area, 4) the wear amount of the organic photosensitive layer per predetermined unit time under each of the various conditions, when the developer bearing member contacts the image bearing member, as cd1, cd2, . . . cdn for the first area, and 5) ed1, ed2 . . . edn for the second area, wherein the image bearing member life estimation unit measures tc1, tc2, . . . tcn which are times respectively associated with the various conditions in a state where the developer bearing member is separated from the image bearing member, and td1, td2, . . . tdn which are times respectively associated with each of the various conditions in a state where the developer bearing member contacts the image bearing member, calculates a total wear amount in the first area and the second area as a total wear amount SCn and a total wear amount SEn by each of the measured times and a wear amount in each of the various conditions per predetermined unit time according to $$SCn=\Sigma(cci\times tci+cdi\times tdi);\ i=1\text{to } n,$$

$$SEn=\Sigma(eci\times tci+edi\times tdi);\ i=1 \text{ to } n,$$

compares the threshold value SC and the threshold value SE, and determines that the image bearing member has reached the end of its life if the total wear amount SCn is equal to or greater than the threshold value SC or the total wear amount SEn is equal to or greater than the threshold value SE.

5. The image forming apparatus according to claim 1, further comprising a development device contact/separation mechanism configured to cause the developer bearing member to contact the image bearing member and separate the developer bearing member from the image bearing member, wherein the plurality of different portions of the organic photosensitive layer includes a first area corresponding to a developer bearing area bearing the developer in an axial direction of the developer bearing member and a second area corresponding to a developer non-bearing area not bearing the developer at outer sides of both ends of the developer bearing area, and wherein the storage member stores:

1) a film thickness SCI of the organic photosensitive layer in the first area in an unused state and a film thickness SEI of the organic photosensitive layer in the second area in an unused state, 2) an end-of-life film thickness SCE in the first area and an end-of-life film thickness SEE in the second area, 3) the wear amount of the organic photosensitive layer per predetermined unit time under each of various conditions (a number n of conditions (n≥1)) where a condition of a process unit, which acts on the image bearing member, is different, when the developer bearing member is separated from the image bearing member, as cc1, cc2, . . . ccn for the first area 4) ec1, ec2 . . . ecn for the second area, 5) the wear amount per predetermined unit time under each of the various conditions, when the developer bearing member contacts the image bearing member, as cd1, cd2, . . . cdn for the first area, and 6) ed1, ed2 . . . edn for the second area, wherein the image bearing member life estimation unit measures tc1, tc2, . . . tcn which are times respectively associated with the various conditions in a state where the developer bearing member is separated from the image bearing member, and td1, td2, . . . tdn which are times respectively associated with the various conditions in a state where the developer bearing member contacts the image bearing member, calculates a total wear amount in the first area and the second area as a total wear amount SCn and a total wear amount SEn by each measured time and a wear amount in each of the various conditions per predetermined unit time according to $$SCn=\Sigma(cci\times tci+cdi\times tdi);\ i=1 \text{ to } n,$$

$$SEn=\Sigma(eci\times tci+edi\times tdi);\ i=1 \text{ to } n,$$

calculates $$SCr=SCI-SCn,$$

$$SEr=SEI-SEn,$$

where a differences between the film thickness SCI in the unused state and the film thickness SEI and the calculated total wear amount SCn and the total wear amount SEn is a difference SCr and a difference SEr, compares the difference SCr and the end-of-life film thickness SCE and the difference SEr and the end-of-life film thickness SEE, and determines that the image bearing member has reached the end of its life if the difference SCr is equal to or less than the value of the end-of-life film thickness SCE or the difference SEr is equal to or less than the end-of-life film thickness SEE.

6. An image forming apparatus comprising:

a rotatable image bearing member having an organic photosensitive layer on a surface, a charging member configured to charge the surface of the image bearing member, an exposure unit configured to form a latent image by exposing the surface of the charged image bearing member, a development device configured to cause a developer bearing member bearing developer to develop the latent image;

a cleaning member configured to clean the surface of the image bearing member, the apparatus comprising:

a storage unit configured to store a first threshold of a first wear amount of a first area of the organic photosensitive layer and a second threshold of a second wear amount of a second area of the organic photosensitive layer; and an image bearing member life estimation unit configured to estimate the first and second wear amounts, compare the first and second wear amounts and the first and second thresholds, and send out a message informing that the image bearing member has reached the end of its life if any of the first and second wear amounts reaches a respective threshold, and wherein a first threshold corresponds to the first area and a second threshold corresponds to the second area, and wherein the first and second wear amounts are determined based on a measured length of time of contact between the image bearing member and the developer bearing member and a measured length of time of separation between the image bearing member and the developing bearing member.

7. The image forming apparatus according to claim 6, wherein the plurality of different portions of the organic photosensitive layer includes the first area corresponding to a developer bearing area bearing the developer in an axial direction of a developer bearing member included in the development device and the second area corresponding to a developer non-bearing area not bearing the developer at outer sides of both ends of the developer bearing area.

8. The image forming apparatus according to claim 6, further comprising a development device contact/separation mechanism configured to cause a developer bearing member included in the development device to contact the image bearing member and separate the developer bearing member from the image bearing member.

9. An image forming apparatus comprising:

an image bearing member;

a development device configured to cause a developer bearing member bearing developer to develop a latent image;

a storage unit configured to store a threshold value associated with a wear amount of an organic photosensitive layer; and a control unit configured to determine whether or not the wear amount reaches one of first and second thresholds, wherein the image bearing member includes a first area and a second area which is different from the first area, wherein the first threshold corresponds to the first area and the second threshold corresponds to the second area, and wherein the first and second wear amounts are determined based on a measured length of time of contact between the image bearing member and the developer bearing member and a measured length of time of separation between the image bearing member and the developing bearing member.

10. The image forming apparatus according to claim 9, wherein the image bearing member includes the first area corresponding to a developer bearing area and the second area corresponding to a developer non-bearing area.

11. The image forming apparatus according to claim 9, wherein a difference between a wear amount of the first area and a wear amount of the second area, in a condition where the development device contacts the image bearing member, is greater than a difference in a condition where the development device is separated from the image bearing member.

* * * * *